US007212195B2

(12) United States Patent
Kawasaki

(10) Patent No.: US 7,212,195 B2
(45) Date of Patent: May 1, 2007

(54) DRIVE CIRCUIT, DISPLAY APPARATUS, AND INFORMATION DISPLAY APPARATUS

(75) Inventor: Somei Kawasaki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 404 days.

(21) Appl. No.: 10/650,834

(22) Filed: Aug. 29, 2003

(65) Prior Publication Data

US 2004/0066357 A1 Apr. 8, 2004

(30) Foreign Application Priority Data

Sep. 2, 2002 (JP) ..... 2002-256372
Aug. 28, 2003 (JP) ..... 2003-305078

(51) Int. Cl.
*G09G 5/00* (2006.01)

(52) U.S. Cl. ..... 345/204; 345/80

(58) Field of Classification Search ..... 345/205, 345/36, 214, 80, 45, 204, 46, 76
See application file for complete search history.

(56) References Cited

U.S. PATENT DOCUMENTS 5,459,483 A * 10/1995 Edwards ..... 345/98
6,373,454 B1 4/2002 Knapp et al. ..... 345/76
6,528,951 B2 * 3/2003 Yamazaki et al. ..... 315/169.3
6,858,991 B2 * 2/2005 Miyazawa ..... 315/169.3
6,909,414 B2 * 6/2005 Tsuchi et al. ..... 345/89
2003/0043090 A1 * 3/2003 Yazawa et al. ..... 345/76

FOREIGN PATENT DOCUMENTS

JP 10-74060 3/1998

* cited by examiner

*Primary Examiner*—Richard Hjerpe
*Assistant Examiner*—Jean Lesperance
(74) *Attorney, Agent, or Firm*—Fitzpatrick, Cella, Harper & Scinto

(57) ABSTRACT

The present invention relates to a configuration utilizing a driven element that is driven by a current. Specifically, there is provided a pixel circuit having a driven element and a current-drive transistor for supplying a current for driving the driven element to a current injection terminal of the driven element, a voltage buffer, a current signal line for supplying a current signal to the pixel circuit, and a wiring for connecting an output of the voltage buffer and a gate electrode of the current drive transistor. The pixel circuit has a switch for controlling connection between the voltage buffer and the gate electrode of the current-drive transistor, and an input terminal of the voltage buffer is connected to the current signal line.

8 Claims, 19 Drawing Sheets

DRIVE CIRCUIT, DISPLAY APPARATUS, AND INFORMATION DISPLAY APPARATUS

BACKGROUND OF THE INVENTION

1. Field of the Invention

The present invention relates to a circuit for driving a driven element that is driven by injecting a current to the same. The invention also relates to a display apparatus utilizing the circuit.

2. Description of the Related Art

One type of driven elements which can be driven by injecting a current are electroluminescent elements (hereinafter referred to as EL elements) which are made to emit light by injecting a current. A circuit for driving such an element may be constituted by an insulated gate field effect transistor such as a TFT (thin film transistor).

EL elements are used in panel type image display systems (hereinafter referred to as EL panels) in which pixel circuits constituted by TFTs are two-dimensionally arranged.

A configuration utilizing EL elements is disclosed in U.S. Pat. No. 6,373,454.

SUMMARY OF THE INVENTION

It is an object of the invention to provide a novel configuration for driving driven elements which are driven by injecting a current and, more particularly, to provide a configuration utilizing current-drive transistors for passing a current through driven elements, wherein gate electrodes of the current-drive transistors can be properly charged.

A first aspect of the invention is a drive circuit at least comprising:

a pixel circuit having a driven element and a current-drive transistor for supplying a current for driving the driven element to a current injection terminal of the driven element;

a voltage buffer;

a current signal line for supplying a current signal to the pixel circuit; and a wiring for connecting an output of the voltage buffer and a gate electrode of the current-drive transistor, wherein the pixel circuit has a switch for controlling the connection between the voltage buffer and the gate electrode of the current-drive transistor; and an input terminal of the voltage buffer is connected to the current signal line.

A second aspect of the invention is a drive circuit according to the first aspect of the invention, wherein the voltage buffer has a source-follower circuit.

A third aspect of the invention is a drive circuit according to the first aspect of the invention, wherein the voltage buffer is a feedback type voltage buffer.

A fourth aspect of the invention is a drive circuit according to the first, second or third aspect of the invention, wherein the voltage buffer has a current source and wherein a current value of the current source corresponds to a current supplied to the current signal line during a predetermined period.

A fifth aspect of the invention is a drive circuit according to any of the first to fourth aspects of the invention, wherein the pixel circuit further has a switch for controlling connection between an electrode of the current-drive transistor other than the gate electrode and the current signal line.

A sixth aspect of the invention is a drive circuit according to any of the first to fourth aspects of the invention, wherein the pixel circuit further has a switch for controlling connection between an electrode of the current-drive transistor for passing a current through the driven element and the driven element.

A seventh aspect of the invention is a drive circuit according to any of the first to fourth aspects of the invention, wherein the pixel circuit further has: a first switch for controlling connection between an electrode of the current-drive transistor other than the gate electrode and the current signal line; and a second switch for controlling connection between an electrode of the current-drive transistor for passing a current through the driven element and the driven element.

An eighth aspect of the invention is a drive circuit according the seventh aspect of the invention, wherein the first switch and the second switch are controlled such that there is a period in which the first switch keeps the current signal line and the current-drive transistor connected to each other and the second switch keeps the current-drive transistor and the driven element disconnected from each other and such that there is a period in which the first switch keeps the current signal line and the current-drive transistor disconnected from each other and the second switch keeps the current-drive transistor and the driven element connected to each other.

In particular, a configuration for controlling the first switch and the second switch in a complementary manner may preferably be employed.

A ninth aspect of the invention is a drive circuit according to any of the first to eighth aspects of the invention, further comprising a switch for controlling connection between a current supply circuit and the current signal line.

A tenth aspect of the invention is a drive circuit according to the ninth aspect of the invention, wherein the current supply circuit and the current signal line are connected for a predetermined period before a gate potential of the current-drive transistor is determined according to the current signal and are disconnected from each other after the predetermined period passes.

A eleventh aspect of the invention is a drive circuit comprising:

a plurality of pixel circuits each including a driven element which is driven by passing a current therethrough and a current-drive transistor for passing a current through the driven element;

a current signal line for sequentially supplying a current signal to each of the plurality of pixel circuits; and a current path line to serve as a current path for sequentially passing a current for determining a gate potential of the current-drive transistor of each of the plurality of pixel circuits, wherein the gate potential of the current-drive transistor is set such that a current corresponding to the current signal is made to flow between a source electrode and a drain electrode of the current-drive transistor by the flow of the current signal through the current signal line and the flow of the current for changing the gate potential of the current-drive transistor through the current path line and wherein the current flowing through the current-drive transistor is thereafter supplied to the driven element while maintaining the gate potential.

A twelfth aspect of the invention is a drive circuit according to any of the first to eleventh aspects of the invention, wherein the driven element is an electroluminescent element.

A thirteenth aspect of the invention is a display apparatus utilizing the drive circuit according to any of the first to twelfth aspects of the invention, wherein a plurality of the pixel circuits is arranged in the form of a matrix.

A fourteenth aspect of the invention is an information display apparatus for performing display in accordance with information inputted thereto, having an information input part and the display apparatus according to the thirteenth aspect of the invention that performs display in accordance with information inputted to the information input part.

In the present specification, a first terminal and a second terminal of a switch are two terminals which are controlled by the switch with respect to conduction between them, and the conduction of the switch is controlled by a control signal that is inputted to a control terminal of the switch. A first main electrode and a second main electrode of a transistor are two electrodes other than a gate electrode, i.e., a source electrode and a drain electrode.

BRIEF DESCRIPTION OF THE DRAWINGS

The invention will become more readily appreciated and understood from the following detailed description of a preferred embodiment of the invention when taken in conjunction with the accompanying drawings, in which.

DESCRIPTION OF THE PREFERRED EMBODIMENTS

The inventor has been studying driving of an EL element.

Luminescence setting methods for a EL element include a voltage setting method and a current setting method. Each of the methods will be described below.

<EL Panel Using Voltage Setting Method>

Figure 12:
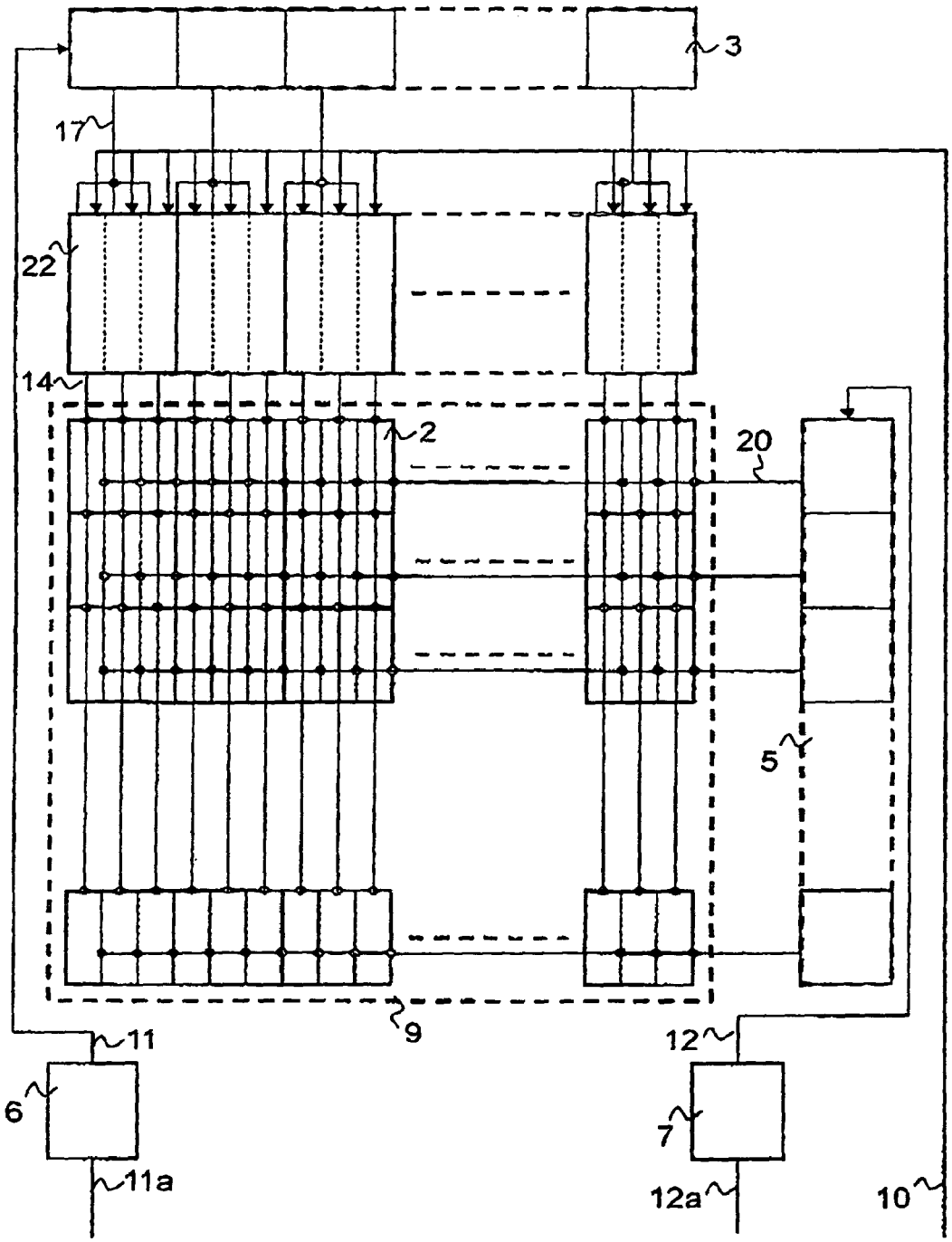
FIG. 12 is a schematic diagram of an entire circuit of an EL panel using a voltage setting method.

The circuit construction of a color EL panel using a voltage setting method is shown in FIG. 12.

Input video information 10 is inputted to appropriate ones of column control circuits 22. The column control circuits 22 are provided for each of R, G and B, that is to say, by a number which is three times the number of horizontal pixels of the EL panel. A horizontal scanning control signal 11*a* is inputted to an input circuit 6. A horizontal scanning control signal 11 outputted from the input circuit 6 is inputted to a horizontal shift register 3. The horizontal shift register 3 is made of registers that are equal in number to the horizontal pixels of the EL panel. The horizontal scanning control signal 11 is made of a horizontal clock signal and a horizontal scanning start signal. Horizontal sampling signals 17 outputted from the respective terminals of the horizontal shift register 3 are inputted to the corresponding ones of the column control circuits 22.

Figure 14:
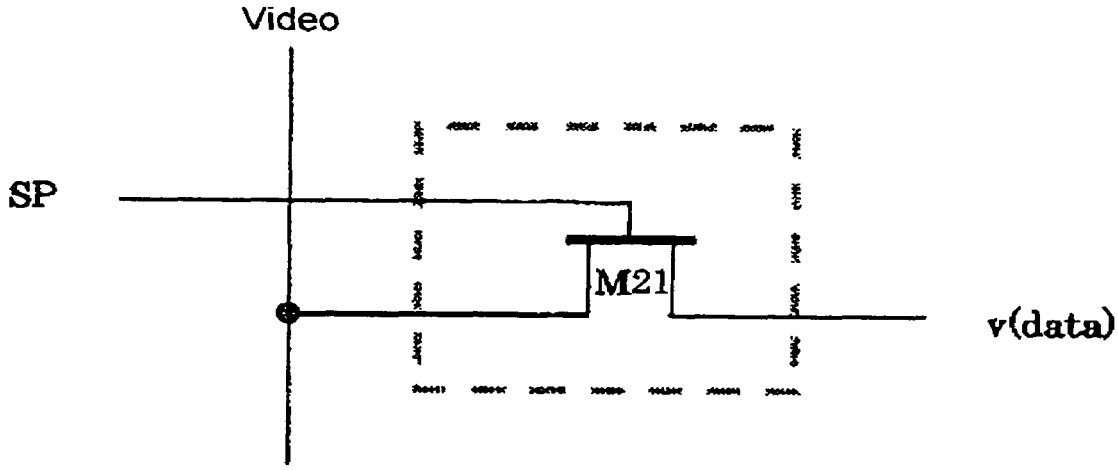
FIG. 14 is a circuit diagram of a column control circuit used in the EL panel using the voltage setting method.

The construction of each of the column control circuits 22 is very simple. As shown in FIG. 14, a horizontal sampling signal SP is connected to a gate of a transistor M21, an input video signal Video (one of RGB colors) is connected to the source M21/S, and video voltage data v(data) which is a column control signal 14 is outputted from the drain M21/D.

In the present specification, the gate electrode, source electrode, and drain electrode of a transistor may be represented by abbreviated symbols /G, /S, and /D, respectively, and a signal and a signal line for supplying the signal may be represented by like reference numeral. The transistors represented by reference symbols Mi (i represents natural numbers) in the figure are not limited to TFTs, and they may be insulated gate field effect transistors fabricated using single crystal silicon.

In an image display area 9, a plurality of pixel circuits 2 each having an equivalent construction are two-dimensionally arranged. Each of the pixel circuits 2 is responsible for driving any one of R, G and B EL display elements, and a set of three pixel circuits 2 is responsible for the display of one pixel.

The video voltage data v(data) outputted from each of the column control circuits 22 is inputted to the pixel circuits 2 arranged in the same column. In addition, a vertical scanning control signal 12*a* is inputted to an input circuit 7, and a vertical scanning control signal 12 outputted from the input circuit 7 is inputted to a vertical shift register 5. The vertical shift register 5 includes registers that are equal in number to the vertical pixels of the EL panel. This vertical scanning control signal 12 is made of a vertical clock signal and a vertical scanning start signal. A row control signal 20 outputted from each output terminal of the vertical shift register 5 is inputted to the pixel circuits 2 arranged in the same row.

Pixel Circuit Using Voltage Setting Method

Figure 13:
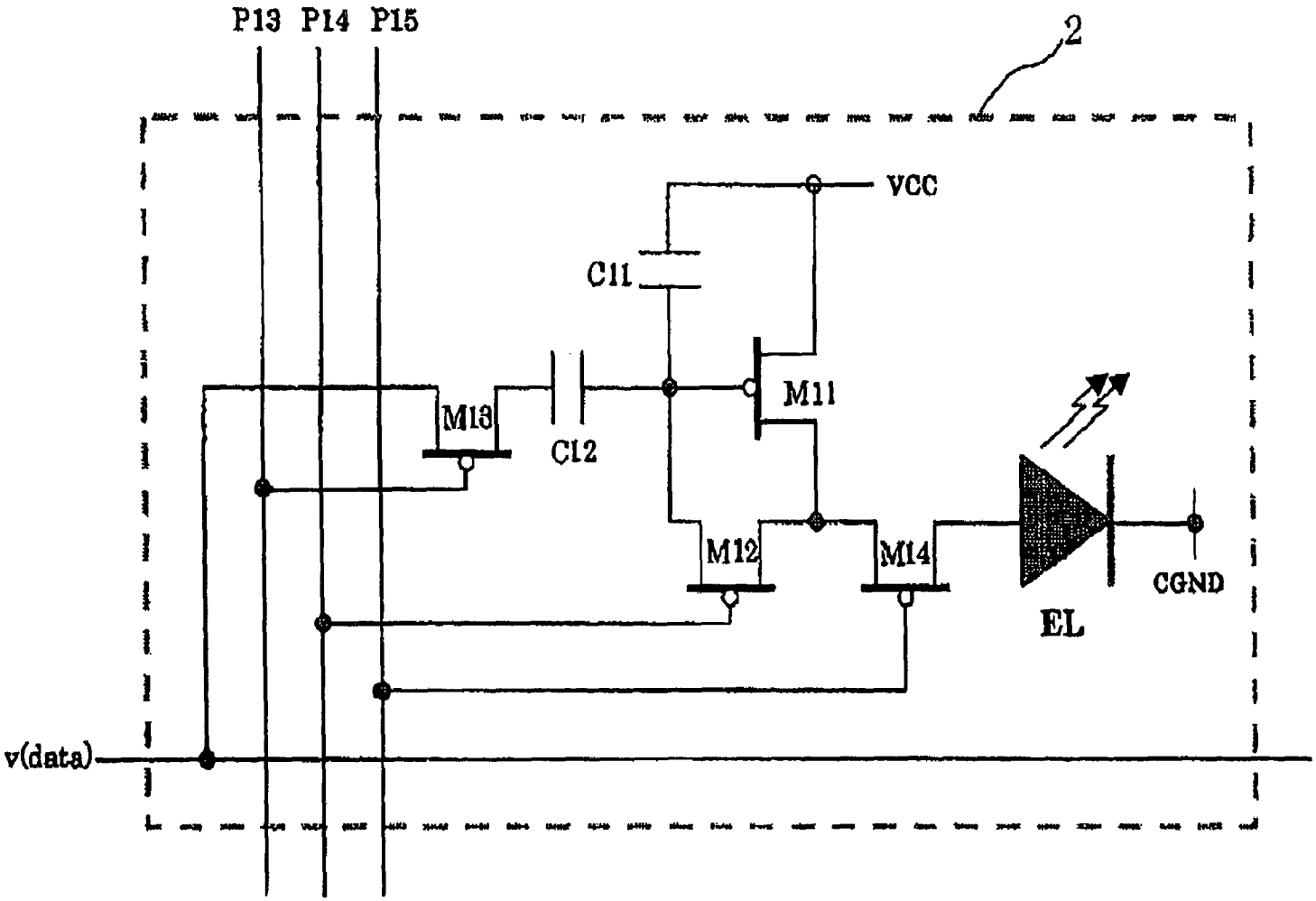
FIG. 13 is a circuit diagram of a pixel circuit used in the EL panel using the voltage setting method.

The construction of one of the pixel circuits 2 using the voltage setting method is shown in FIG. 13.

The video voltage data v(data) is connected to a source of a transistor M13. The row control signals 20 correspond to P13, P14 and P15 which are respectively connected to the gate M13/G and gates of transistors M12 and M14. The drain M13/D is connected to a capacitor C12, and the capacitor C12 is connected to a capacitor C11 and a gate of a transistor M11 whose source is connected to a power source. The drain M11/D and the gate M11/G are respectively connected to the drain M12/D and the source M12/S, and the drain M11/D is connected to the source M14/S. The drain M14/D is connected to a current injection terminal of an EL element which is grounded at one terminal.

Figure 15:
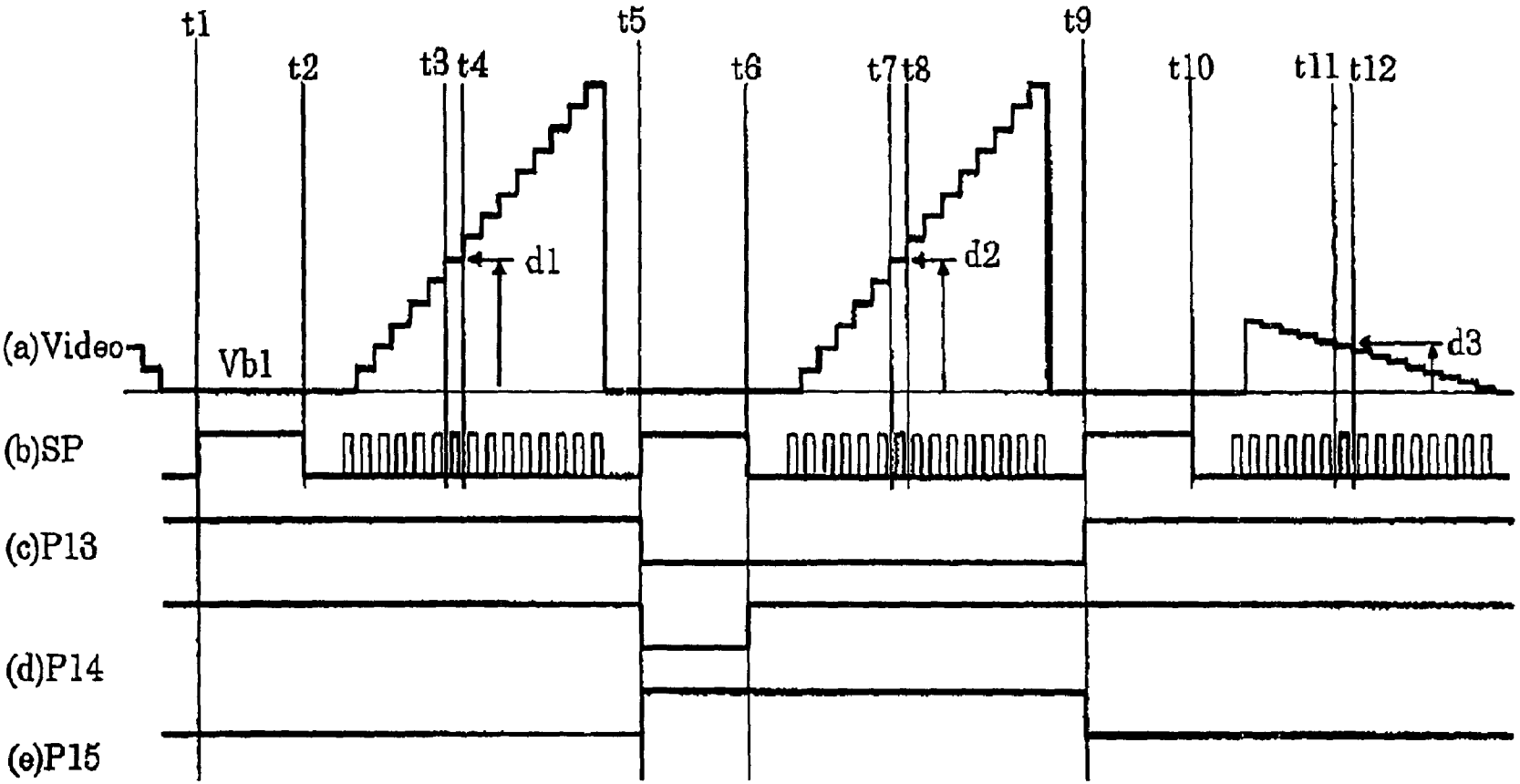
FIG. 15 is a time chart for explaining operations of the circuit shown in FIG. 13.

The operation of the EL panel shown in FIG. 12 will be described below with reference to the time chart shown in FIG. 15. In FIG. 15, a waveform (a) shows the input video signal Video, a waveform (b) shows the horizontal sampling signal SP, and waveforms (c) to (e) show the row control signals P13 to P15 for the corresponding row. Incidentally, FIG. 15 shows three horizontal periods, that is to say, three row periods.

First, during the period from time t1 to time t2 within a horizontal blanking period of the input video signal, all horizontal sampling pulses SP are simultaneously changed to their H levels, and during this time a blanking voltage which is the input video signal is set to the column control signal 14. Incidentally, in the waveform (b) of FIG. 15, the horizontal sampling signal SP for the corresponding column is shown as a thick line.

(Before Time t5 (Luminescence Holding Period))

During the period from time t1 to time t5, in the pixel circuit 2 for the corresponding row, the respective row control signals P13 to P15 are held at the H level, the H level and the L level. Therefore, during the period from time t1 to time t2, even when all horizontal sampling pulses SP simultaneously change to the H levels, the transistors M12, M13 and M14 of the pixel circuit 2 are respectively remain off, off and on. Accordingly, the drain current of the transistor M11 that is determined by the capacitor C11 and the M11/G voltage of the corresponding pixel circuit 2 which is the holding voltage of the gate capacitance of the transistor M11 is injected into the corresponding EL element, and the EL element continues its luminescence. Incidentally, during the period from time t1 to time t2 within the horizontal blanking period, the voltage of the input video signal Video is a voltage Vb1 near a black level as shown in FIG. 15.

(From Time t5 to Time t9 (Luminescence Setting Period))

At time t5, the row control signals P13 and P15 for the corresponding row respectively change to the L level and the H level. During the period from time t5 to time t6, all horizontal sampling pulses SP are again simultaneously changed to the H levels, and during this time a blanking voltage which is the input video signal is set to the column control signal 14.

During this time, in the pixel circuit 2 for the corresponding row shown in FIG. 13, the transistor M14 is turned off to stop supplying current to the EL element, whereby the EL element is turned off. In addition, since each of the transistors M12 and M13 is placed in the on state, the capacitors C11 and C12 as well as the gate capacitance of M11 perform their discharge operations so that a (VCC−M11/G) voltage progressively approaches the threshold voltage Vth of the transistor M11. Accordingly, the drain current of the transistor M11 is reset to a very small value. Incidentally, during the period from time t5 to time t6 within the horizontal blanking period, the voltage of the input video signal Video is the voltage Vb1 near the black level as shown in FIG. 15, similarly to that during the period from time t1 to time t2.

At time t6, the respective signals SP and P14 go to the L level and the H level, but the (VCC−M11/G) voltage of the pixel circuit 2 continues to be the threshold Vth of the transistor M11.

During the period from time t7 to time t8, the signal SP for the corresponding column goes to the H level, and an input video signal value d2 obtained at this time is inputted to the pixel circuit 2 as the video voltage data v(data). At this time, the M11/G voltage of the pixel circuit 2 changes by the voltage ΔV. The voltage ΔV is approximately expressed by Equation (1):

$$\Delta V=-d2\times C12\div(C12+C11+C(M11)), \tag{1}$$

where C(M11) represents the gate input capacitance of the transistor M11 in the pixel circuit 2.

At time t8, the signal SP again changes to the L level and the change of the M11/G voltage expressed by Equation (1) is held, and this state is held until time t9.

(From Time t9 to Time t12 (Luminescence Holding Period))

At time t9, the respective row control signals P13 and P15 change to the H level and the L level, and the transistors M13 and M14 of the pixel circuit 2 respectively go to the off state and the on state. The drain current of the transistor M11 that is determined by the M11/G voltage of the corresponding pixel circuit that has changed in this manner is injected into the corresponding EL element, and a variation occurs in the amount of luminescence and this state is held.

During the periods from time t9 to time t10 and from time t11 to time t12, the signal SP changes to the H level, but since the transistor M13 of the pixel circuit 2 is off, the luminescent operation of the EL element is not influenced.

Equation (1) means that the amount of luminescence can be set by a voltage value (d2) based on the voltage Vb1 appearing during the horizontal blanking period of the input video signal Video. The drain current Id of the transistor M11 of the pixel circuit 2 can be approximately expressed by Equation (2):

$$Id=\beta\times\Delta V2. \tag{2}$$

Since the EL element basically performs a luminescent operation proportionate to an injected current, it can be seen from Equation (2) that in the EL panel using the voltage setting method shown in FIG. 12, the amount of luminescence of the EL element of each pixel can be controlled with a value proportionate to the second power of the input video signal level based on the blanking voltage.

The EL panel using the voltage setting method has the advantage that the circuit construction of a liquid crystal panel having an established reputation can be used except for the pixel circuit 2. However, since the current driving coefficient β of the TFT elements varies from element to element, it is difficult to control variation of luminance of each pixel. Thus, the voltage setting method has a problem when high image quality must be achieved.

<EL Panel Using Current Setting Method>

Figure 5:
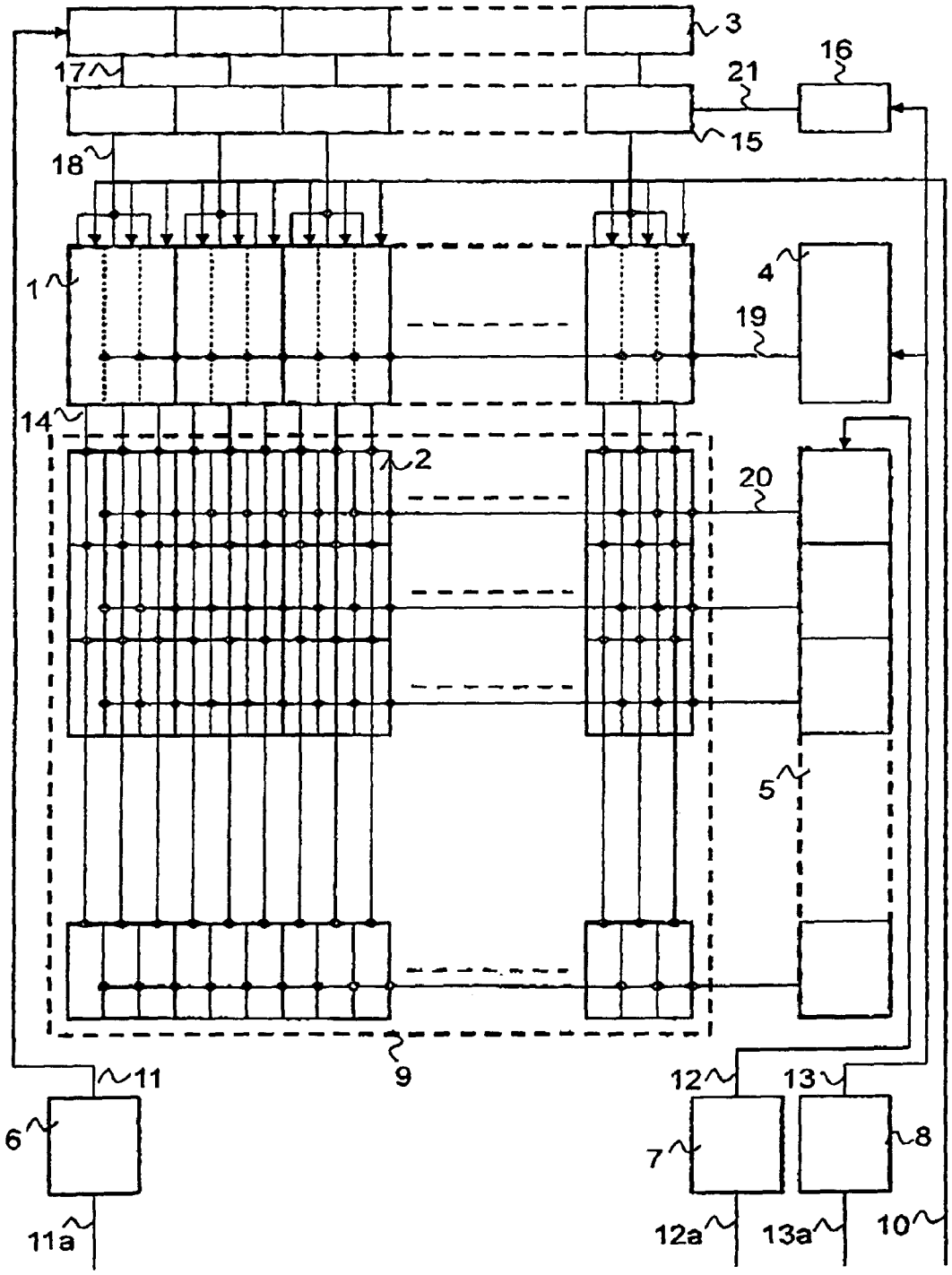
FIG. 5 is a schematic diagram of an entire circuit of an EL panel using a current setting method.

The circuit construction of a color EL panel using a current setting method is shown in FIG. 5. First of all, the difference between the EL panel shown in FIG. 5 and the EL panel using the voltage setting method shown in FIG. 12 will be described below.

An auxiliary column control signal 13*a* is inputted to an input circuit 8, and an auxiliary column control signal 13 outputted from the input circuit 8 is inputted to gate circuits 4 and 16. The horizontal sampling signals 17 outputted from the respective terminals of the horizontal shift register 3 are respectively inputted to gate circuits 15. Horizontal sampling signals 18 converted by the respective gate circuits 15 are inputted to column control circuits 1. A control signal 21 outputted from the gate circuit 16 is inputted to the gate circuits 15. A control signal 19 outputted from the gate circuit 4 is inputted to the column control circuits 1.

[Column Control Circuit]

Figure 8:
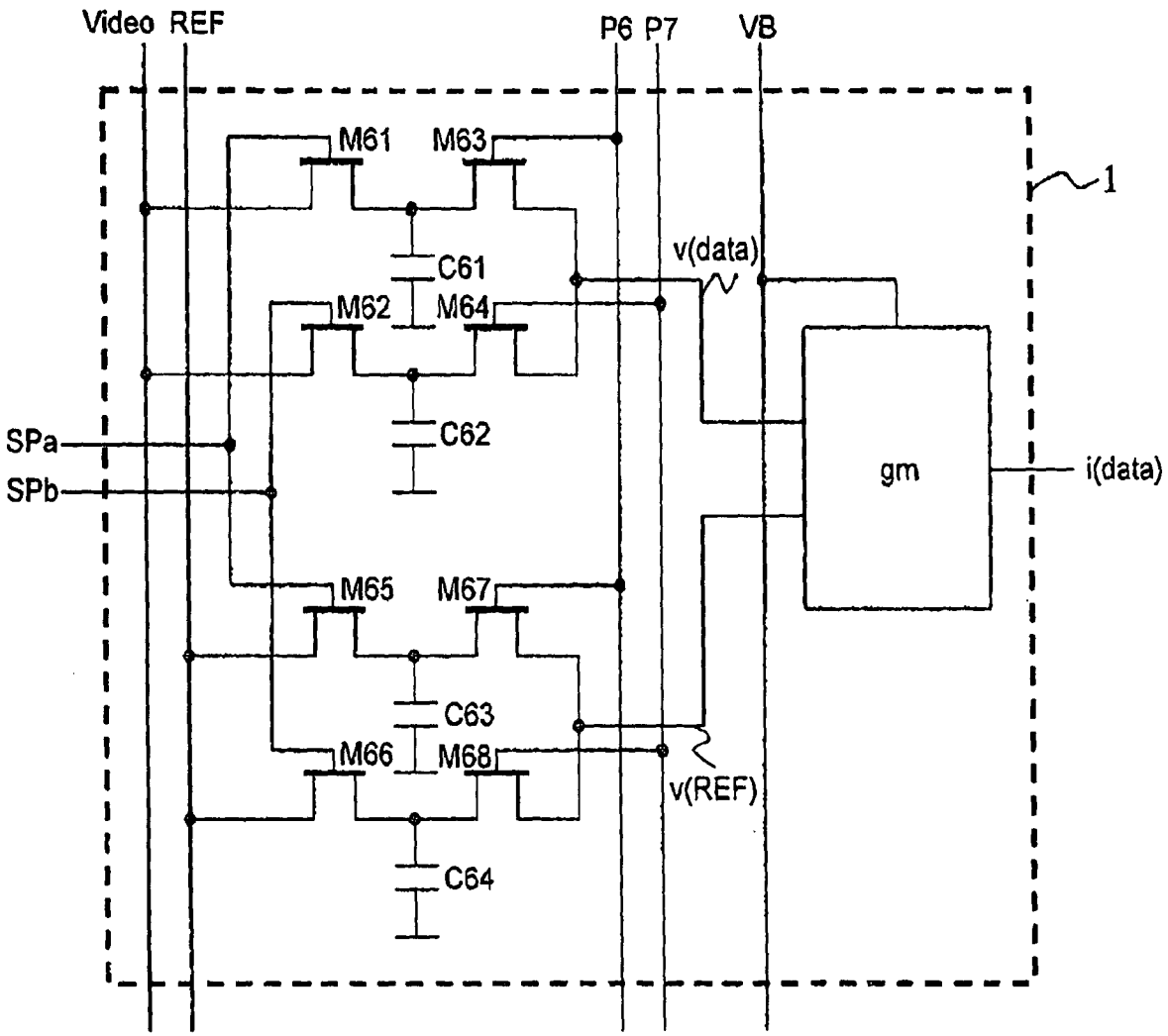
FIG. 8 is a circuit diagram of a column control circuit used in the EL panel using the current setting method.

The construction of one of the column control circuits 1 of the EL panel using the current setting method is shown in FIG. 8. The column control circuits 1 are disposed by the same number as the number of horizontal pixels of the EL panel.

Input video information is made of an input video signal Video and a reference signal REF, and the input video signal Video is inputted to sources of transistors M61 and M62, while the reference signal REF is inputted to sources of transistors M65 and M66. Each of the horizontal sampling signals 18 outputted from the gate circuits 15 is made of signals SPa and SPb. The signal SPa is connected to the gates M61/G and M65/G, while the signal SPb is connected to the gates M62/G and M66/G. Capacitors C61, C62, C63 and C64 are respectively connected to the drains M61/D, M62/D, M65/D and M66/D, and sources of transistors M63, M64, M67 and M68 are also respectively connected to the drains M61/D, M62/D, M65/D and M66/D. The control signal 19 is made of signals P6 and P7, and the signal P6 is connected to the gates M63/G and M67/G, while the signal P7 is connected to the gates M64/G and M68/G. The drains M63/D and M64/D are connected to each other and a voltage v (data) is inputted to a voltage-current conversion circuit gm, while the drains M67/D and M68/D are connected to each other and a voltage v(REF) is inputted to the voltage-current conversion circuit gm. In addition, a reference current setting bias VB is inputted to the voltage-current conversion circuit gm, and the voltage-current conversion circuit gm outputs a current signal i(data) to be used as the column control signal 14.

Figure 10:
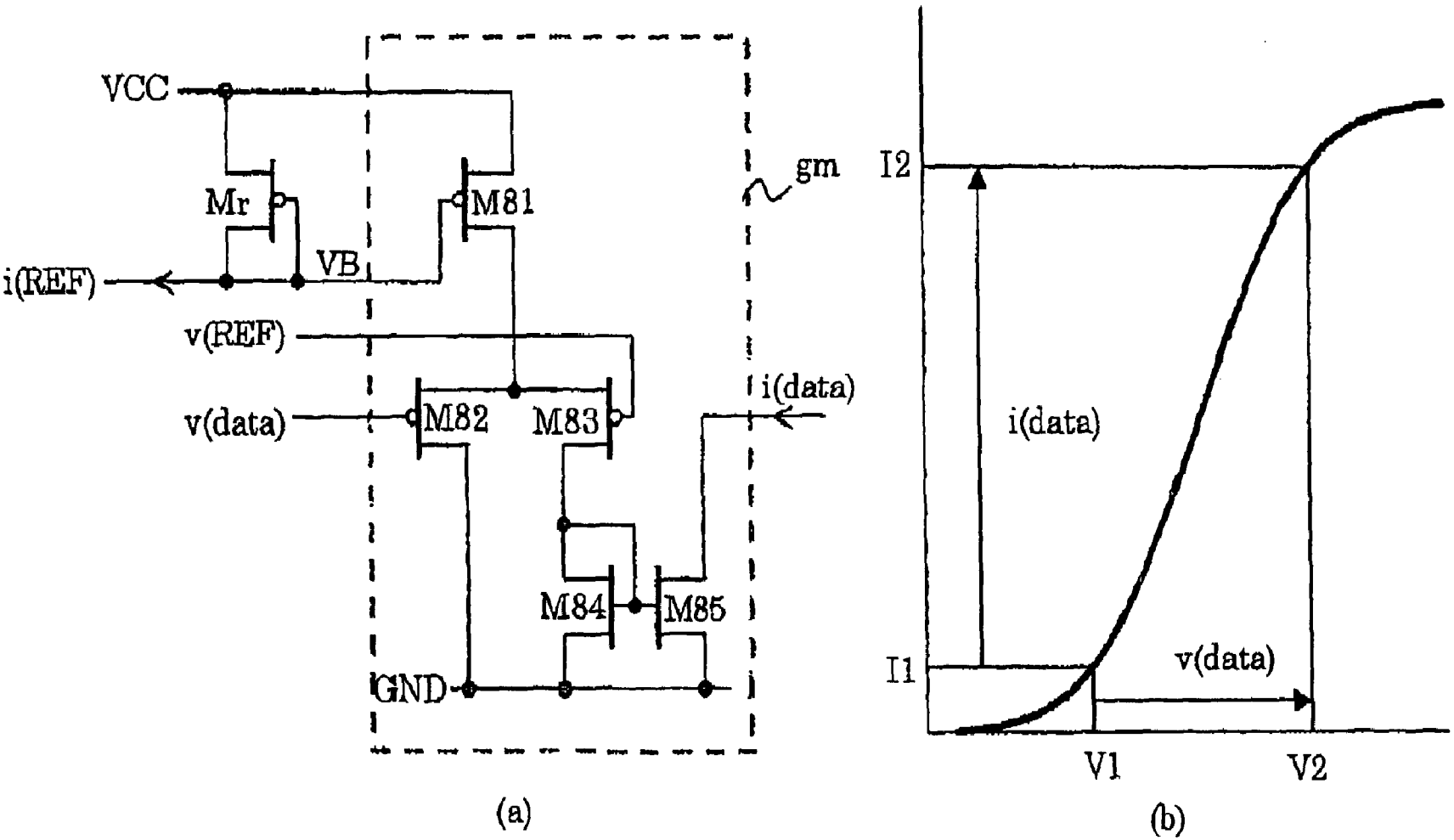
FIG. 10(*a*) is a circuit diagram of a voltage-current conversion circuit used in an EL panel using the current setting method, and FIG. 10(*b*) illustrates voltage-current conversion characteristics of the circuit shown in FIG. 10(*a*)

A construction example of the voltage-current conversion circuit gm is shown in FIG. 10(*a*). Although its basic operation is general and the description thereof is omitted, it is to be noted that if an EL panel designed to have a power saving function is, for example, a 200-ppi EL panel, the amount of current to be injected into the EL element of each pixel of this EL panel is assumed to be as small as a maximum of 100 nA which is greatly smaller than 1 μA. In order to obtain as linear a voltage-current conversion characteristic as possible under this condition, it is necessary to reduce the W/L ratio of the gate region of each of transistors M82 and M83 to reduce the current driving capabilities thereof.

FIG. 10(*b*) shows the voltage-current conversion characteristic of the circuit shown in FIG. 10(*a*). In the voltage-current conversion circuit shown in FIG. 10(*a*), it is difficult to adopt a design which causes a minimum current I1 (black current) relative to a minimum voltage V1 (black level) to become a zero current. If the black current I1 cannot be made to be a zero current, it becomes impossible to ensure contrast important to an image display panel.

Figure 11:
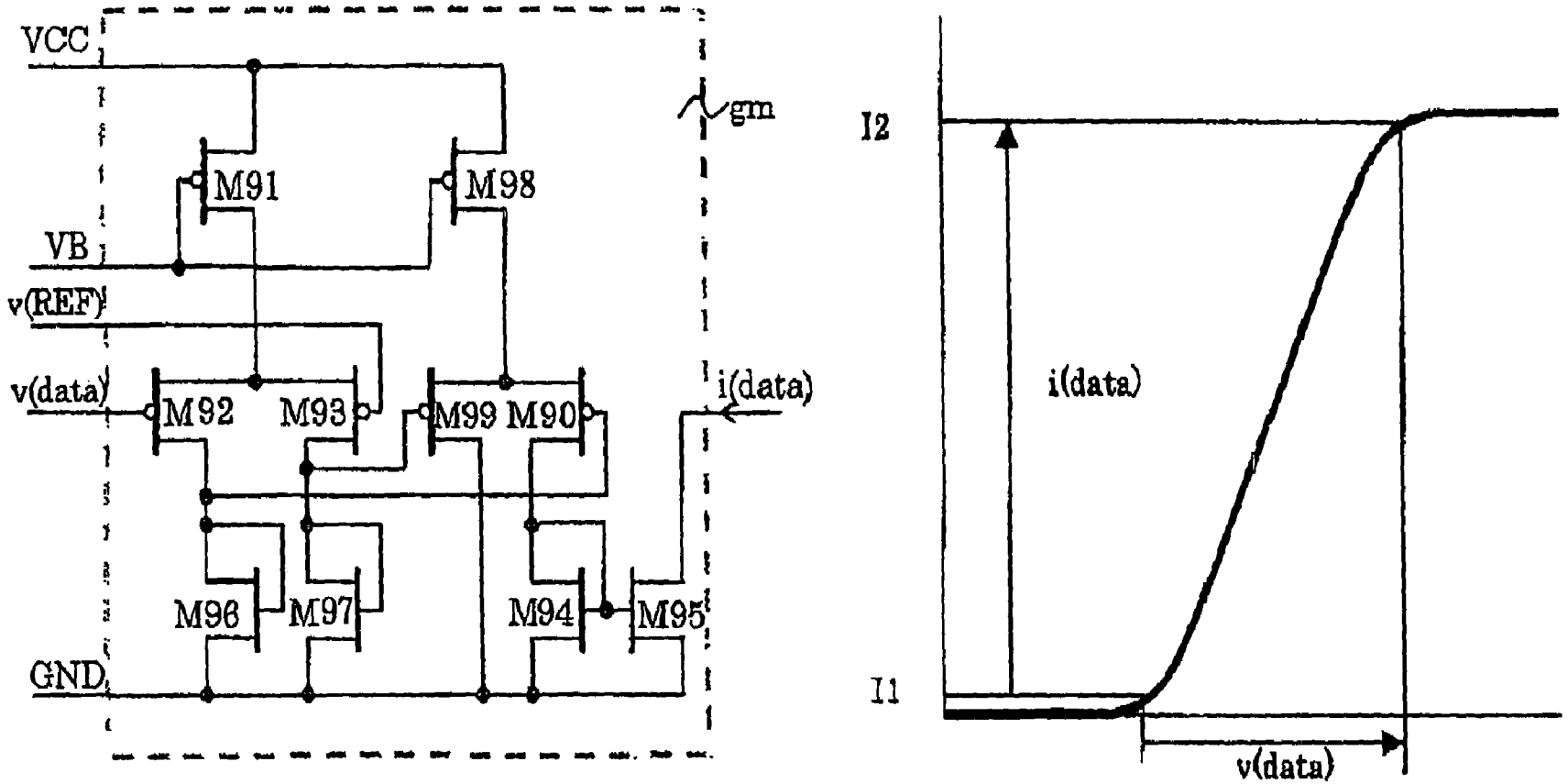
FIG. 11(*a*) is a circuit diagram of another voltage-current conversion circuit used in an EL panel using the current setting method, and FIG. 11(*b*) illustrates voltage-current conversion characteristics of the circuit shown in FIG. 11(*a*)

A construction example of a voltage-current conversion circuit which copes with this point is shown in FIG. 11(*a*). Transistors M96 and M97 each of which has a grounded source and a drain and a gate shorted together are respectively connected to the drain terminals of transistors M92 and M93 of a first source-coupled circuit. In addition, the voltage-current conversion circuit is provided with M98 which has a source connected to a power source and a gate connected to the reference current bias VB and operates as a second reference current source, and a drain of a transistor M98 is connected to transistors M99 and M90 of a second source-coupled circuit. The gates M99/G and M90/G are respectively connected to the drains M97/D and M96/D. The current signal i(data) which becomes the column control signal 14 is outputted from the drain M90/D via the current mirror circuit of transistors M94 and M95 similarly to the voltage-current conversion circuit shown in FIG. 10(*a*).

In order to make the current driving capabilities of the transistors M96 and M97 smaller than those of the transistors M99 and M90 in the circuit shown in FIG. 11 (*a*), the W/L ratio of the gate region of each of the transistors M96 and M97 is made smaller than the W/L ratio of the gate region of each of the transistors M99 and M90.

The voltage-current conversion characteristic of the voltage-current conversion circuit of FIG. 11(*a*) which is designed in this manner is shown in FIG. 11(*b*). As shown, it is possible to reduce the black current I1 relative to the black level V1, and it is possible to realize the linearity of the voltage-current conversion characteristic without impairing such linearity.

Figure 9:
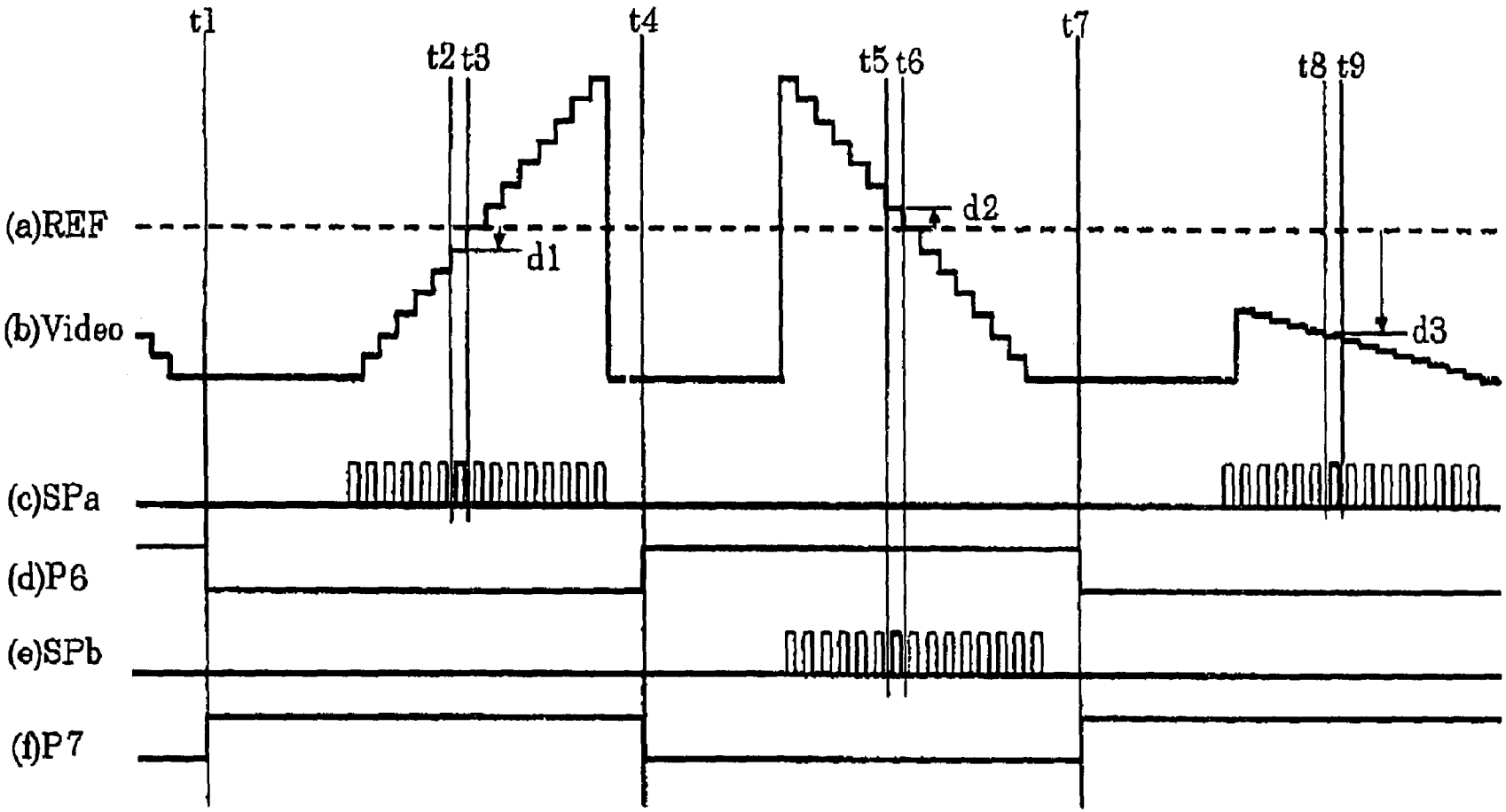
FIG. 9 is a time chart for explaining operations of the circuit shown in FIG. 8.

The operation of the column control circuit will be described below with reference to the time chart shown in FIG. 9.

At time t1, the control signals P6 and P7 respectively change to the L level and the H level.

During the effective period of the input video signal from time t1 to time t4, horizontal sampling signals SPa are generated. During the period from time t2 to time t3, a horizontal sampling signal SPa for the corresponding column is generated, and the input video signal Video and the reference signal REF at this time are sampled in the capacitors C61 and C63 and are held after time t3 as well.

At time t4, the control signals P6 and P7 respectively change to the H level and the L level, and a voltage (v(data)−v(REF)) to be inputted to the voltage-current conversion circuit becomes d1. The voltage-current conversion circuit outputs as the column control signal 14 the current signal i (data) obtained during the period from time t4 to time t7 on the basis of video information received during the period from time t2 to time t3.

During the effective period of the input video signal from time t4 to time t7, horizontal sampling signals SPb are generated. During the period from time t5 to time t6, a horizontal sampling signal SPb for the corresponding column is generated, and the input video signal Video and the reference signal REF at this time are sampled in the capacitors C62 and C64 and are held after time t6 as well.

At time t7, the control signals P6 and P7 respectively again change to the L level and the H level, and the voltage (v(data)−v(REF)) to be inputted to the voltage-current conversion circuit gm becomes d2. The voltage-current conversion circuit outputs the current signal i(data) for one horizontal scanning period after time t7 as the column control signal 14 on the basis of video information received during the period from time t5 to time t6.

During the effective period of the input video signal for one horizontal scanning period after time t7, horizontal sampling signals SPa are again generated. During the period from time t8 to time t9, a horizontal sampling signal SPa for the corresponding row is generated, and the input video signal Video and the reference signal REF at this time are sampled in the capacitors C62 and C64 and are held after time t9 as well.

The above-described operation is repeated, whereby the current signal i(data) which is the column control signal 14 is converted into a progressive signal which is updated every horizontal scanning period of the input video signal Video.

[Pixel Circuit Using Current Setting Method]

Figure 6:
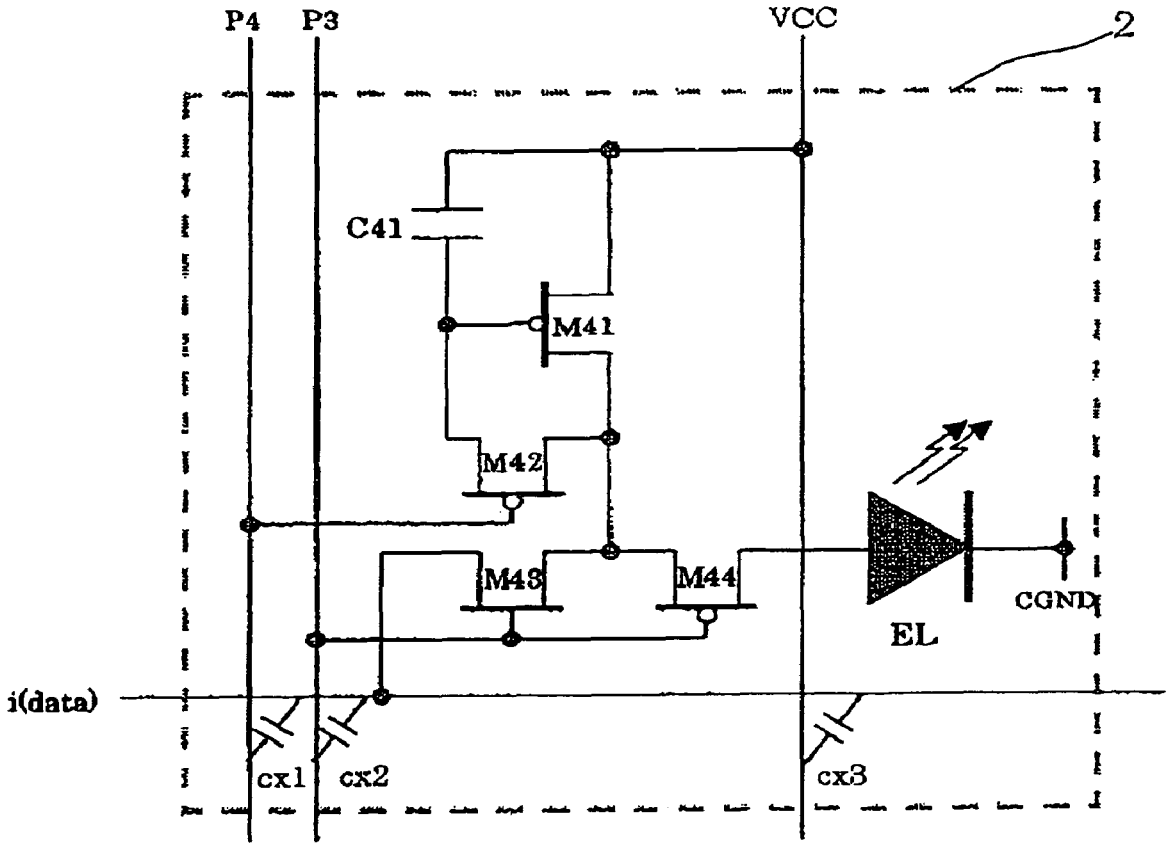
Fig. 6 PRIOR ART
FIG. 6 is a circuit diagram of a pixel circuit according to the related art used in the EL panel using the current setting method.

FIG. 6 shows an example of a pixel circuit 2 using the current setting method. Signals P3 and P4 correspond to the row control signals 20. The current signal i(data) is inputted as the column control signal 14. A drain of a transistor M44 is connected to the current injection terminal of a grounded EL element.

The operation of the pixel circuit will be described below with reference to the time chart shown in FIG. 7. Before time t0, since the signals P3 and P4 for the corresponding row (m) are at the L level and the H level, respectively, both transistors M42 and M43 are off and the transistor M44 is on. Accordingly, a current is injected into the EL element by a gate voltage of a transistor M41 which is determined by charged voltages held in a capacitor C41 and the gate capacitance of the transistor M41, and the EL element is performing luminescence according to the injected current.

At time t0, both of the signals P3 and P4 for the corresponding row change to the H level and the L level, respectively, and the current signal i(m) for the m-th row is established. Since both the transistors M42 and M43 are turned on and the transistor M44 is turned off, the supply of current to the EL element for the corresponding row is stopped and the EL element for the corresponding row is turned off. In addition, since the current signal i(m) is supplied to M41, the M41/G voltage is set according to this current signal i(m), and the capacitor C41 and the gate capacitance of the transistor M41 are charged.

At time t1 when the current signal i(m) is established, the signal P4 again changes to the H level and the transistor M42 goes to the off state, and the operation of setting the M41/G voltage is completed and a holding operation starts.

At time t2, the signal P3 changes to the L level and the supply of current to the transistor M41 is stopped, and the transistor M44 is turned on and the drain current of the transistor M41 which is set by the M41/G voltage is injected into the EL element. According to this injected current, the EL element starts luminescence which is again set before time t1, and continues this state until the drain current of the transistor M41 is again set.

The pixel circuit 2 using the current setting method in FIG. 6 is advantageous in that it is not affected by variations of the threshold voltage Vth and current driving coefficient β of each transistor and in that, when the value of the current signal i(data) is sufficiently great, an output current of the transistor M41 can be at a desired value to reproduce an image with high fidelity to the input video signal on the panel.

In FIG. 6, since the current signal i(data) which is a column control signal 14 intersects the signals P3 and P4 which are a row control signal 20, there are parasitic capacitance cx1 and cx2. In addition, the signal intersects the power source voltage VCC to result in a parasitic capacitance cx3.

Figure 7:
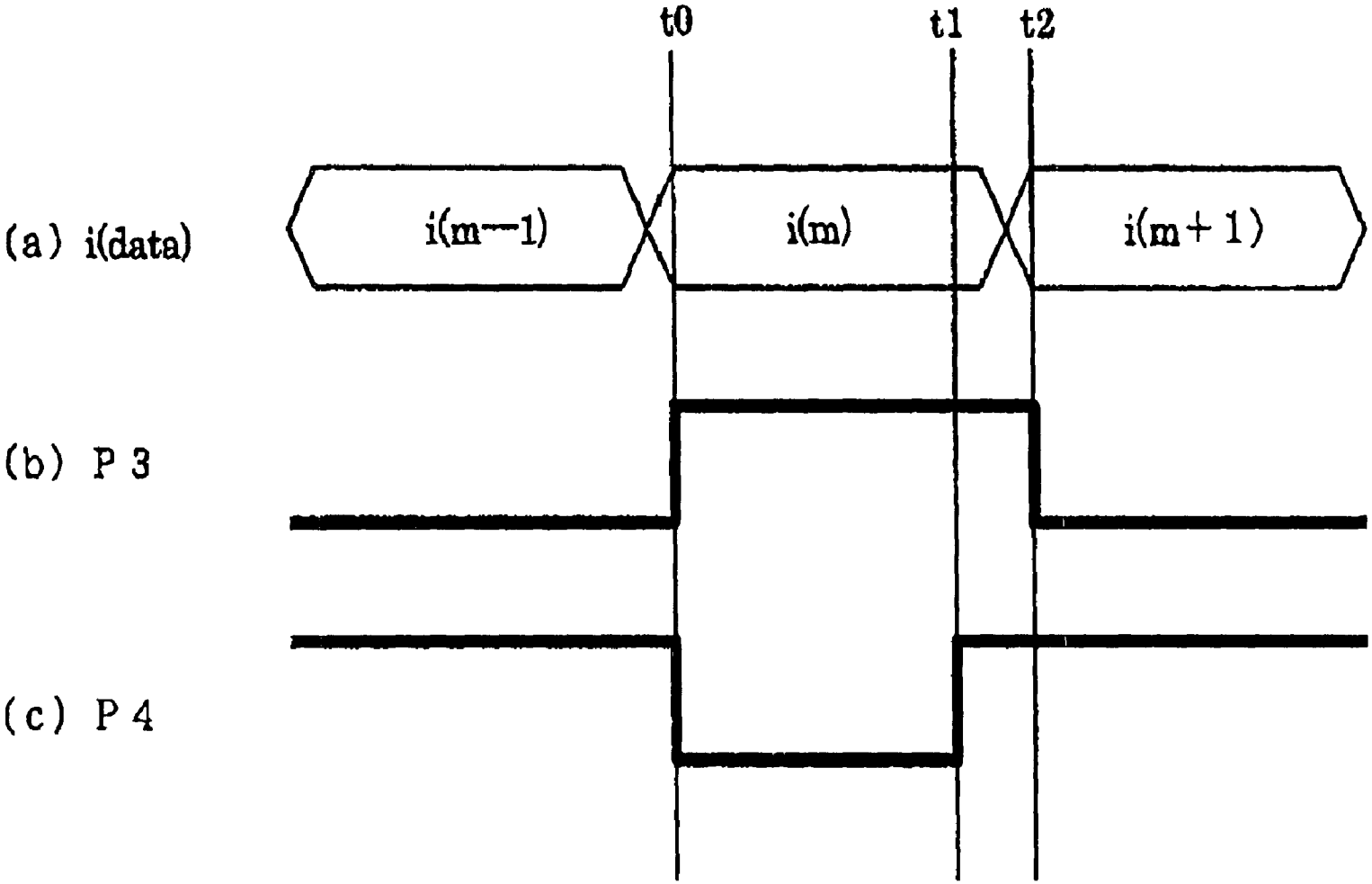
FIG. 7 is a time chart for explaining operations of the circuit shown in FIG. 6.

Consideration is therefore needed for the operation of charging the capacitor C41 to set the current for driving the transistor M41 in the period from t0 to t1 in FIG. 7. Capacitance Csum1 added to the gate M41/G in the period from t0 to t1 is expressed by Equation (3):

$$Csum1 = C41 + N \times (cx1 + cx2 + cx3). \quad (3)$$

N in Equation (3) represents the number of pixels of the EL panel in the vertical direction. For example, N=240 when the EL panel is of the QVGA (320×240) size.

In order to make the pixel circuit 2 shown in FIG. 6 operate as desired, not only the capacitance of the capacitor C41 but also the capacitance Csum1 expressed by Equation (3) including the parasitic capacitance cx1 to cx3 must be charged with the current signal i(data).

While the pixel circuit 2 must be controlled with a small current to achieve high contrast, since a small current takes a longer time to charge the capacitance Csum1 including the retention capacitance of the capacitor C41, the setting operation with the small current performed in one horizontal scanning period may become insufficient. This problem becomes more significant in a TFT circuit in which variation ΔVth of the threshold voltage of the current drive transistor M41 of the pixel circuit 2 for each row is great.

However, the capacitance value of the retention capacitor C41 cannot be so small in order to maintain the current driving operation in one frame period of an input video signal Video. Further, since power saving is anticipated from an EL panel, the pixel circuits 2 must be driven by a smaller current, and it is therefore difficult to achieve high image quality on an EL panel utilizing an EL element drive circuit including the pixel circuits of the related art using the current setting method shown in FIG. 6.

The mode of carrying out the invention described below has a configuration in which the above-described specific problems can be solved. Specifically, the configuration allows the time required for the setting operation to be reduced even when a current signal inputted to pixel circuits using the current setting method is a small current.

Figure 1:
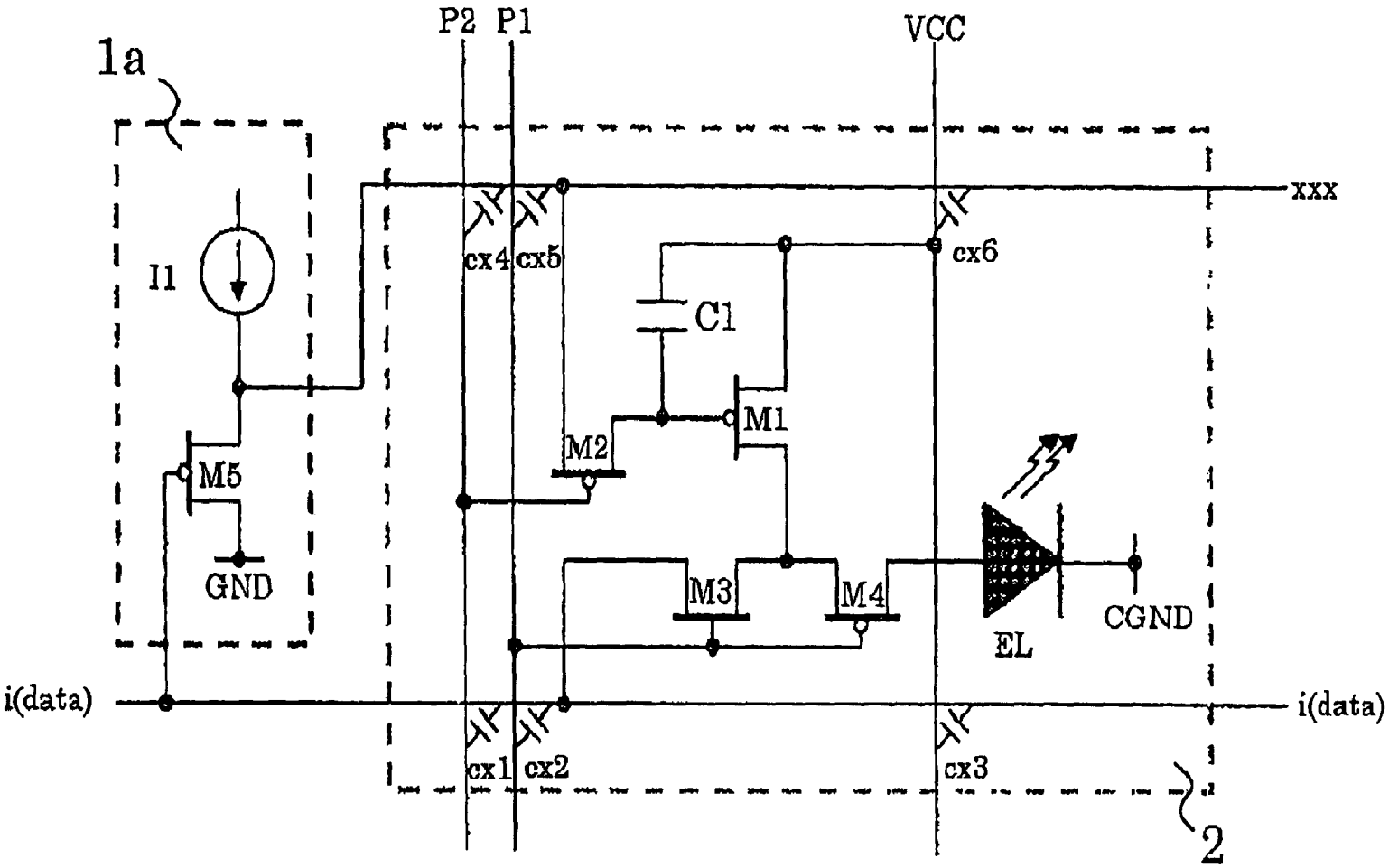
FIG. 1 is a circuit diagram showing the state of connection between a pixel circuit and a voltage buffer included in an embodiment of an EL element drive circuit according to the invention.

FIG. 1 is a circuit diagram showing the state of connection between a pixel circuit and a voltage buffer included in a mode for implementation of an EL element drive circuit according to the invention. The term "EL element drive circuit" as used here means a circuit used in an EL panel using the current setting method as described above in detail and shown in FIG. 5, the circuit including a plurality of pixel circuits in an image display area 9 and EL element drive control circuits surrounding the image display area 9 such as a column control circuit 1.

While the invention will now be described with reference to the specific mode for carrying out the same shown in FIG. 1, the invention is not limited to the same mode.

An electroluminescent element drive circuit according to the invention has at least a pixel circuit 2 enabling a light-emitting operation of an electroluminescent element EL (hereinafter referred to as an EL element) which are connected to a first power source CGND at one terminal thereof, on the basis of a current signal inputted from a current signal line i(data) and a voltage buffer 1*a* whose output voltage is determined by a voltage inputted thereto. As shown in FIG. 1, the pixel circuit 2 includes at least first to third switches (M3, M4, and M2) and a current drive transistor M1. A first terminal of the first switch M3 is connected to the current signal line i(data). A second terminal of the first switch M3 is connected to a first terminal of the second switch M4 which operates in a complementary relationship with the first switch M3, and is connected to a second main electrode of the current drive transistor M1 whose first main electrode is connected to a second power source VCC. A second terminal of the second switch M4 is connected to a current injection terminal that is another terminal of the EL element. A first terminal of the third switch M2 is connected to an output terminal of the voltage buffer 1*a*. A second terminal of the third switch M2 is connected to a gate electrode of the current drive transistor M1. An input terminal of the voltage buffer 1*a* is connected to the current signal line i(data). In the preferred mode shown in FIG. 1, in order to achieve a preferable state of retention of a setting voltage, a retention capacitor C1 is connected between the gate electrode and the second main electrode of the current drive transistor. Provided between the output of the voltage buffer 1*a* and the gate electrode of the current drive transistor M1 are a wiring for connecting them and the third switch M2 which is a switch for controlling the state of connection between the output of the voltage buffer 1*a* and the gate of the current drive transistor M1.

While FIG. 1 shows only one pixel circuit for clarity of illustration, a plurality of pixel circuits are provided in practice, and the pixel circuits are commonly connected to a wiring between the current signal line and the voltage buffer. The plurality of pixel circuits constitutes a group of pixel circuits in the column direction. A plurality of such groups of pixel circuits in the column direction collectively constitutes a matrix of pixel circuits.

The use of such an EL element drive circuit makes it possible to charge the retention capacitor C1 and other capacitance to be charged quickly and to thereby reduce the time required for setting a gate voltage of the current drive transistor M1 of the pixel circuit 2 even when the gate voltage of the transistor M1 is set using a current signal i(data) having a small value to maintain contrast.

Figure 3:
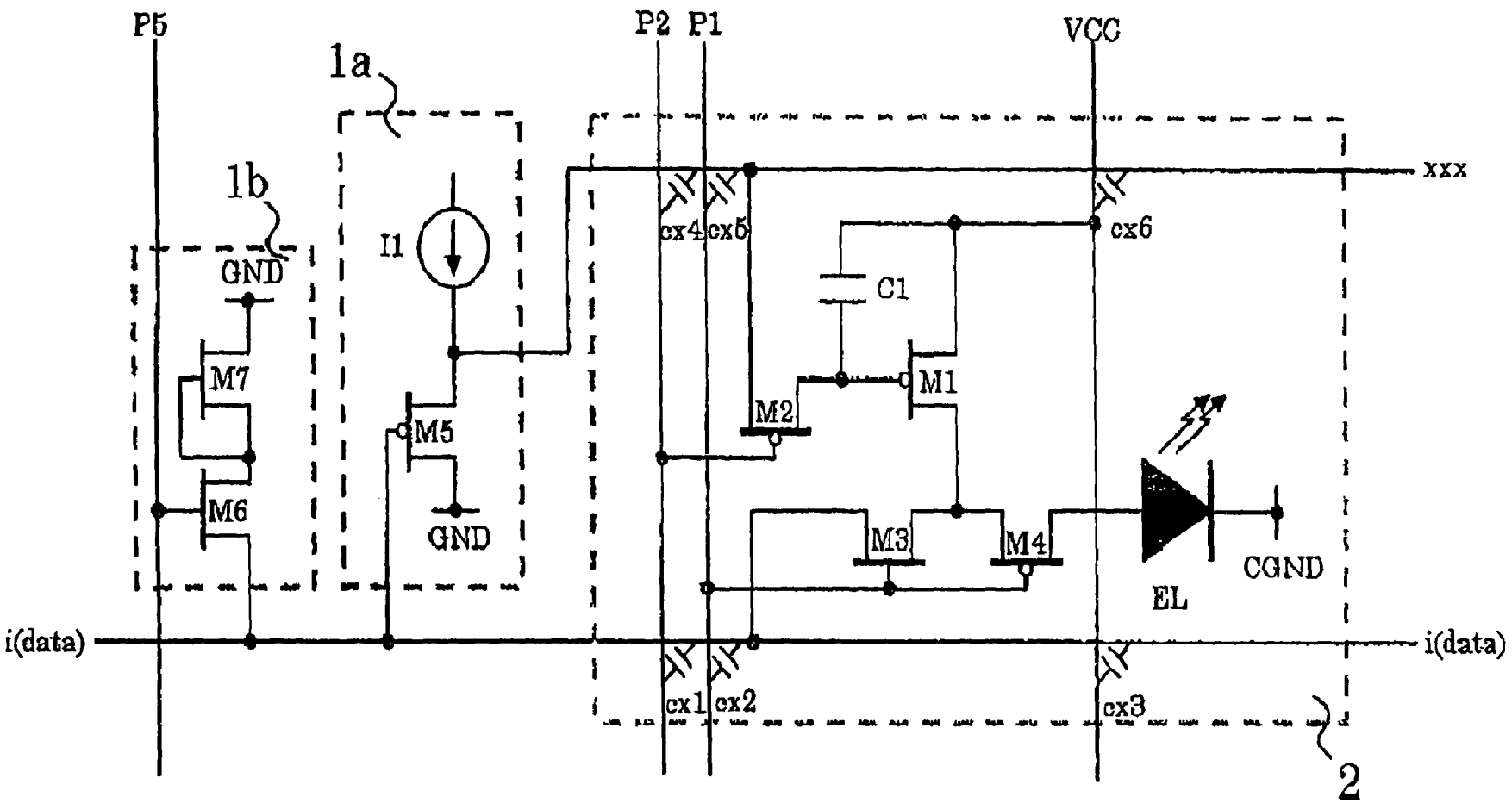
FIG. 3 is a circuit diagram showing the state of connection between a pixel circuit and a voltage buffer and a charging circuit included in another embodiment of an EL element drive circuit according to the invention.

A more preferable mode is a mode as shown in FIG. 3 in which a charging circuit 1*b* is connected to the current signal line i(data). In FIG. 3, the charging circuit 1*b* includes a fourth switch M6 and a current supply circuit M7. A first terminal of the fourth switch M6 is connected to the current signal line i(data), and a second terminal of the fourth switch M6 is connected to the current supply circuit M7.

As a result, the retention capacitor C1 can be charged before the voltage setting operation or at the beginning of the operation regardless of the value of the gate voltage of the transistor M1 before the voltage setting operation and, in particular, the setting operation can be reliably performed even when the gate voltage of the transistor M1 is set using a current signal having a small current value. Such a charging circuit is also advantageous when used in an EL element drive circuit of the related art having pixel circuits using the current setting method as shown in FIG. 6 and having no pixel circuit and voltage buffer as those included in the EL element drive circuit according to the invention.

In the following description of embodiments of the invention, configurations according to the invention and operations of the same will be described more specifically with channel characteristics of transistors specified as done in FIG. 1 in which the transistors M1, M2 and M4 are p-channel transistors and the transistor M3 is an n-channel transistors. However, such specifications are merely examples, and the configurations may be appropriately changed according to any change in the relationship between the potentials of the first power source CGND and the second power source VCC and any reversal of channel characteristics of the transistors.

Embodiment 1

A first control signal P1 and a second control signal P2 in FIG. 1 correspond to the row control signal 20 in FIG. 5. A current signal i(data) is inputted to the circuit in FIG. 1 as a column control signal 14.

The current signal i(data) is connected to the source M3/S. The drain M3/D is connected to the drain of the transistor M1 whose source is connected to the power source VCC, and the drain M3/D is also connected to the source M4/S. The drain M4/D is connected to a current injection terminal of an EL element which is grounded. The row control signal P1 is connected to the gates M3/G and M4/G which are control terminals of the switches.

An input terminal of the voltage buffer 1*a* that is provided in a column control circuit 1 is also connected to the current signal i(data). The voltage buffer circuit 1*a* is constituted by a transistor M5 whose drain is connected to the ground GND and a current source I1 connected to the source M5/S. The gate M5/G serves as an input terminal of the voltage buffer 1*a*, and the source M5/S serves as an output terminal of the voltage buffer 1*a*. The output terminal M5/S is connected to the source M2/S and is connected to the pixel circuits of the same column as a column control signal for charging xxx. The drain M2/D is connected to the gate M1/G. The retention capacitor C1 connected to the power source VCC at one terminal thereof is connected to the gate M1/G. The row control signal P2 is connected to the gate M2/G that is a control terminal of the switch.

Operations of the circuit will be described using the time chart (a) to (c) shown in FIG. 2.

Before time t0, since the signals P1 and P2 for the corresponding row (m) are at the L level and the H level, respectively, both transistors M2 and M3 are off and the transistor M4 is on. Accordingly, a current is injected into the EL element by a gate voltage of a transistor M1 which is determined by charged voltages held in a capacitor C1 and the gate capacitance of the transistor M1, and the EL element is performing luminescence according to the injected current.

At time t0, both of the signals P1 and P2 for the corresponding row change to the H level and the L level, respectively, and the current signal i(m) for the m-th row is established. Since both the transistors M2 and M3 are turned on and the transistor M4 is turned off, the supply of current to the EL element for the corresponding row is stopped and the EL element for the corresponding row is turned off. Further, since the current signal i(m) is supplied to the drain M1/D, the M1/G voltage that changes depending on the output voltage of the voltage buffer 1*a* given by the column control signal for charging xxx comes to an equilibrium state in which the M1/D current is the current signal i(m). The M1/G voltage is determined under such conditions, and the retention capacitor C1 is charged.

At time t1 when the current signal i(m) is established, the signal P2 again changes to the H level and the transistor M2 goes to the off state, and the operation of setting the M1/G voltage is completed and a holding operation starts.

At time t2, the signal P1 changes to the L level and the supply of current to the transistor M1 is stopped, and the transistor M4 is turned on and the drain current of the transistor M1 which is set by the M1/G voltage is injected into the EL element. According to this injected current, the EL element starts luminescence which is set, and continues this state until the drain current of the transistor M1 is again set.

There is parasitic capacitance cx1 to cx3 on the column control line (current signal line) i(data) as shown in FIG. 1, and there is parasitic capacitance cx4 to cx6 on the column control signal line for charging xxx. Therefore, the current setting operation in the period from t0 to t1 must involve an operation of charging capacitance Csum2 that includes parasitic capacitance shown in Equation (4):

$$Csum2=C1+N\times(cx4+cx5+cx6). \quad (4)$$

N in Equation (4) represents the number of pixels of the EL panel in the vertical direction. For example, N=240 when the EL panel is of the QVGA (320×240) size.

At the drain of the transistor M1, it is required to charge parasitic capacitance as given by Equation (5) that exists on the column control signal line i(data), $$Csum3=N\times(cx1+cx2+cx3). \quad (5)$$

While the parasitic capacitance cx4 to cx6 are similar to the parasitic capacitance cx1 to cx3, any problematically significant increase in the charging time can be prevented by employing a predetermined constant current source as the current source I1 that operates as an up current during the setting operation with a small current in which the M1/G voltage must be increased. That is, the capacitor C1 can be quickly charged to achieve a desired potential difference. Further, the operation of charging the retention capacitor C1 is not required for the drain M1/D as indicated by Equation (5), which is also advantageous in that the time required for achieving the equilibrium state of the circuit can be reduced.

In FIG. 1, since the current source I1 contributes when the current signal i (data) is small, it may generate a current that in complementary to the current signal i(data) instead of a constant current. In this case, there is an advantage in that the current consumed by the column control circuit 1 can be constant regardless of the input video signal Video.

The transistors M2, M3, and M4 are required only to perform a switching operation, and there is no particular limit on devices and circuits to be used. The voltage buffer 1*a* is constituted by a source-follower circuit whose circuitry can be simple. The first main electrode of the transistor M5 for the voltage buffer is connected to the constant current source and serves as an output terminal of the voltage buffer. The second main electrode is grounded, and the gate electrode serves as an input terminal of the voltage buffer. However, any configuration may be employed as long as the input and output voltages satisfy the above-described mutual relationship to perform a voltage buffering operation.

Embodiment 2

In this embodiment, an EL panel having an EL element drive circuit according to Embodiment 1 will be described.

Specifically, the EL panel of the present embodiment is an electroluminescent panel in which a plurality of electroluminescent elements is two-dimensionally arranged to display an image, wherein an electroluminescent element drive circuit according to Embodiment 1 is provided; a plurality of pixel circuits is arranged in the form of a matrix; one voltage buffer circuit is provided for a group of pixel circuits in the same column; and a current signal line and a voltage buffer output are connected to a first switch and a third switch of each of the pixel circuits in the same column.

The matrix arrangement of the pixel circuits does not necessarily mean linear alignment of rows and columns of the circuits, and what is required is the ability of forming an image by connecting a row control signal line and a column control signal line to pixel circuits and controlling them appropriately as done in ordinary image display apparatus.

Such an EL panel can be realized by using an active matrix type EL panel according to the current setting method as shown in FIG. 5 and providing it with pixel circuits and voltage buffers as described in Embodiment 1 of the invention as an EL element drive circuit.

Figure 2:
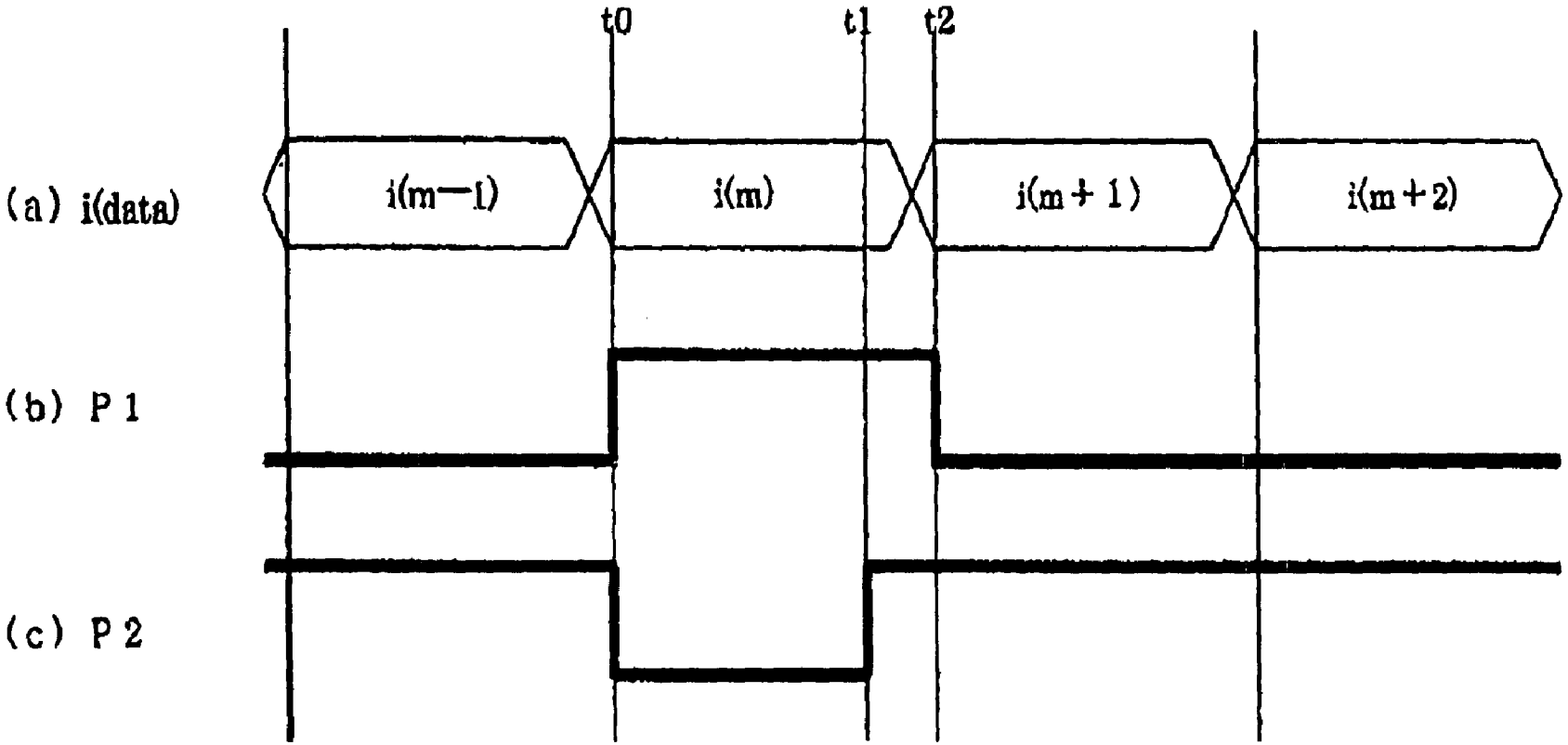
FIG. 2 is a time chart for explaining operations of the circuit shown in FIG. 1.

As apparent from a comparison between FIG. 2 and FIG. 7, the operation of the panel controlled in a manner similar to that for an EL panel of the related art according to the current setting method.

Embodiment 3

FIG. 3 is a circuit diagram showing the state of connection between a pixel circuit, a voltage buffer, and a charging circuit included in Embodiment 3 of an EL element drive circuit according to the invention. The present embodiment is different from Embodiment 1 described with reference to FIG. 1 in that a charging circuit 1*b* is connected to a current signal line.

Differences between FIG. 3 and FIG. 1 will be described.

A drain of a transistor M6 of the charging circuit 1*b* is connected to a column control signal line i(data). The source M6/S is connected to a drain of a transistor M7 whose source is connected to the ground GND and whose drain and gate are shorted. A third control signal P5 included in a control signal 19 is connected to the gate M6/G which is a control terminal of the switch.

Operations of the embodiment will now be described using the time chart in FIG. 4. Referring to a period for setting a M1/G voltage to control each row, the signal P5 is at H level for a predetermined period before the voltage setting period or at the beginning of the period as indicated by (d) in FIG. 4, and a current is supplied to the transistor M1 from the transistor M7 that serves as a current supply source regardless of the current signal i(data). Therefore, the M1/G voltage of a corresponding pixel circuit 2 under the row control decreases once as indicated by (e), so that a retention capacitor C1 is charged. After that, since a corresponding current signal i(m) for the row is inputted, the M1/G voltage increases so that the retention capacitor C1 is discharged to enter an equilibrium state. The current supplied to the transistor M1 can be set properly through appropriate selection of the L/W ratio of the gate of the transistor M7.

When a control signal P2 changes to H level at time t1, the M1/G voltage increases by ΔV because of a drain-gate parasitic capacitance of a transistor M2, which is advantageous in setting zero current to achieve a high contrast ratio that is important for an EL panel.

In the present embodiment, since a pre-charging operation for the retention capacitor C1 can be performed before the voltage setting period or at the beginning of the period as described above, the current setting operation can be made stable especially when using a small current even if there is variation ΔVth of the threshold voltage of the current drive transistor M1 of the pixel circuit 2 of each row.

The transistor M6 is required only to perform a switching operation, and there is no particular limit on devices and circuits to be used. The transistor M7 is a current supply source and is required only to be able to supply a current that is not a small current to the transistor M1.

Embodiment 4

In this embodiment, an EL panel having an EL element drive circuit according to Embodiment 3 will be described.

The EL panel of the present embodiment is an electroluminescent panel in which a plurality of electroluminescent elements is two-dimensionally arranged to display an image, wherein an electroluminescent element drive circuit according to Embodiment 3 is provided; a plurality of pixel circuits is arranged in the form of a matrix; one set of a voltage buffer circuit and a current supply circuit is is provided for a group of pixel circuits in the same column; and a current signal line and a voltage buffer output are connected to a first switch and a third switch of each of the pixel circuits in the same column.

The matrix arrangement of the pixel circuits does not necessarily mean linear alignment of rows and columns of the circuits, and what is required is the ability of forming an image by connecting a row control signal line and a column control signal line to pixel circuits and controlling them appropriately as done in ordinary image display apparatus.

Such an EL panel can be realized by using an active matrix type EL panel according to the current setting method as shown in FIG. 5 and providing it with pixel circuits, voltage buffers and charging circuits as described in Embodiment 3 of the invention as an EL element drive circuit.

Figure 4:
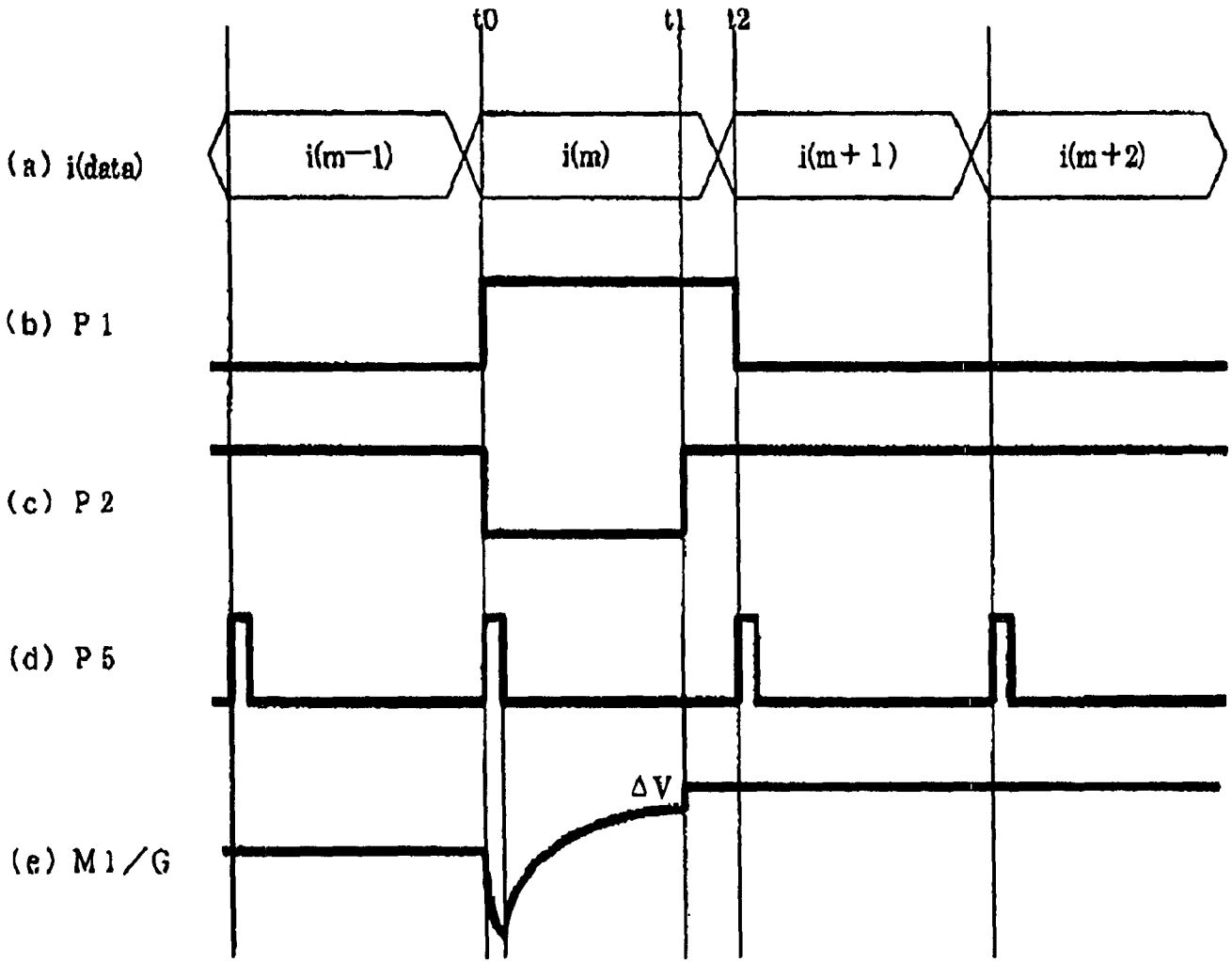
FIG. 4 is a time chart for explaining operations of the circuit shown in FIG. 3.

As apparent from a comparison between FIG. 4 and FIG. 7, the operation of the panel can be controlled in a manner similar to that for an EL panel of the related art according to the current setting method except that a third control signal is supplied as described in Embodiment 3.

Embodiment 5

Figure 16:
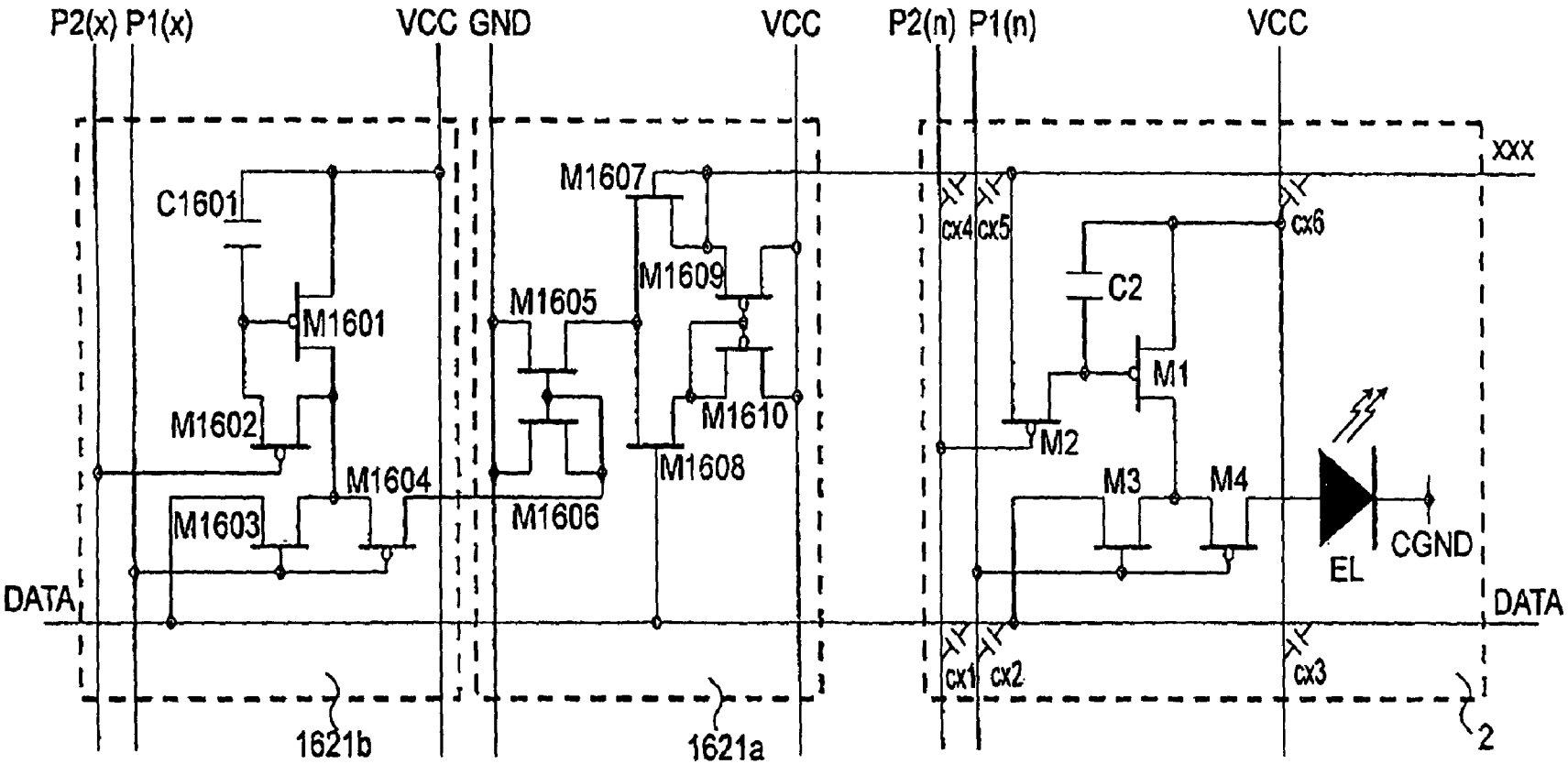
FIG. 16 is a view for explaining an embodiment of the invention.
Figure 18:
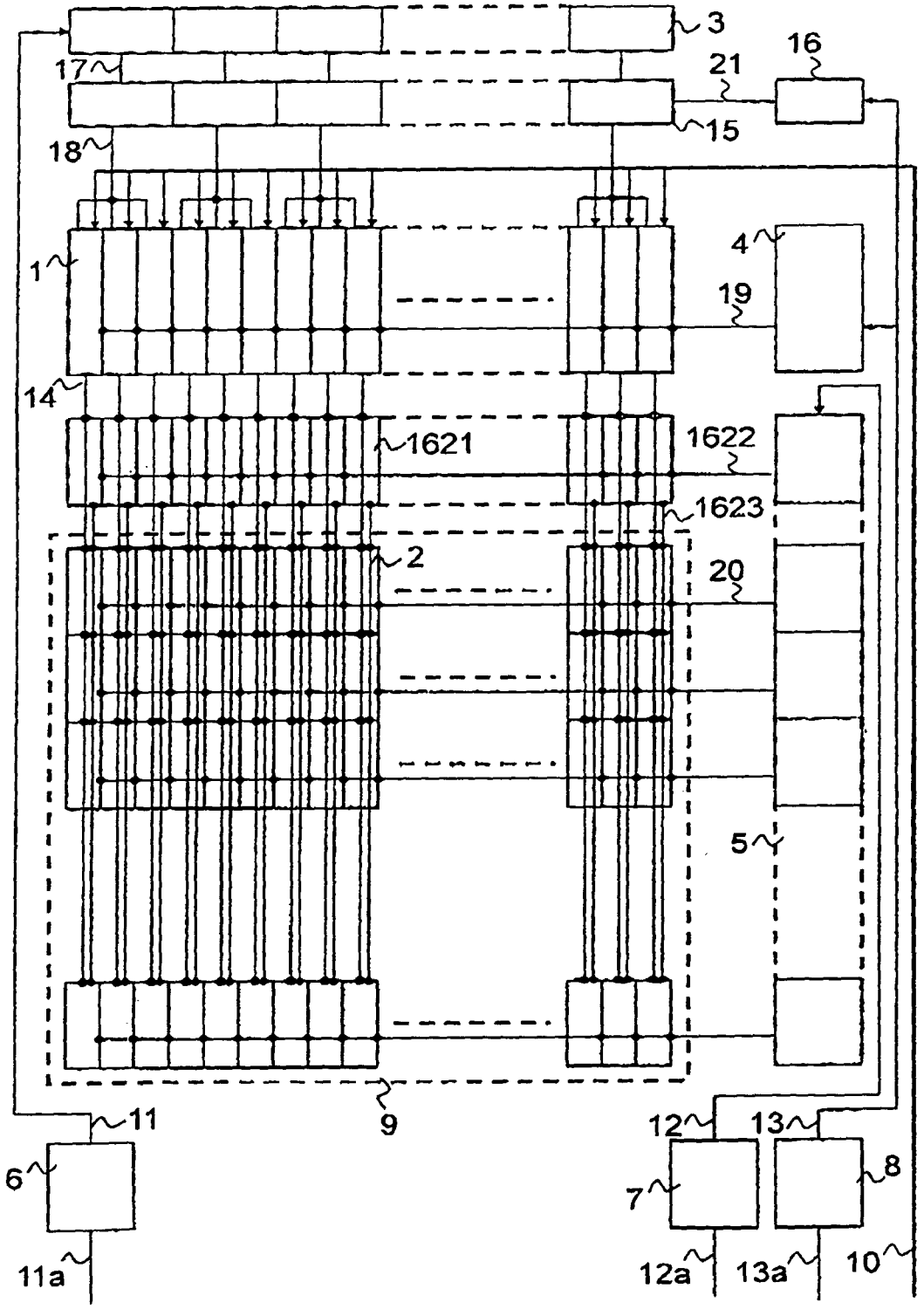
FIG. 18 is a view for explaining the embodiment of the invention.

FIG. 18 shows an EL panel apparatus of the present embodiment. A voltage buffer circuit 1621 is provided on a data line 14 of each column. An auxiliary data line 1623 provided at each voltage buffer circuit 1621 is connected to a respective pixel circuit 2 of the column. The auxiliary data line 1623 corresponds to the wiring that connects the voltage buffer and the third switch M2 in FIG. 1. A row register 5 is added with registers that output control lines 1622 for controlling the voltage buffer circuits 1621. FIG. 16 shows a configuration of the voltage buffer circuit 1621 and the pixel circuit 2 for each column. A current signal output from a column control circuit 1 is supplied to a data line DATA and is connected to the pixel circuit 2. The pixel circuits 2 are provided in the same quantity as that of displayed rows.

(Pixel Circuit)

The data line 14 is connected to the source of a transistor M3 that is controlled by an n-th row scan line P1(n). The drain M3/D is connected to the drain M1/D and the source M4/S. The drain M4/D is connected to a current injection terminal of the corresponding EL element.

The source M1/S is connected to a power source VCC. The capacitor C1 which is connected to the power source VCC at one terminal thereof and the drain of the transistor M2 which is controlled by an n-th row scan line P2(n) are connected to the gate M1/G. The source M2/S is connected to the auxiliary data line (xxx)1623.

(Voltage Buffer Circuit)

The voltage buffer circuit 1621 comprises a feedback type voltage buffer 1621*a* and a current source setting circuit 1621*b*. A data line DATA is connected to a gate of a transistor M1608. A voltage corresponding to a voltage on the data line DATA is outputted to a gate of a transistor M1607 (and the drain M1607/D) and is supplied to the auxiliary data line xxx by a current generated at a drain of a transistor M1605 and the feedback type voltage buffer constituted by transistors M1607, M1608, M1609, and M1610. The data line is connected to a source of a transistor M1603 controlled by a control line P1(x), and the drain M1603/D is connected to a drain of a transistor M1601 and a source of a transistor M1604. The drain M1604/D is connected to a transistor M1606 whose gate and drain are shorted and connected to the gate M1605/G. The drain M1601/D is connected to a drain of a transistor M1602 which is controlled by a control line P2(x), and the source M1602/S is connected to the gate M1601/G. A capacitor C1601 connected to the power source VCC at one terminal thereof is connected to the gate M1601/G.

By employing the configuration in FIG. 16, the pixel circuit 2 can set a current signal supplied to the data line DATA at the transistor M1 according to signals of the n-th row scan lines P1(n) and P2(n) to supply a current to the EL element until the next current setting operation. The retention capacitor C1 of each pixel circuit 2 is subtracted from capacitance that is parasitic on the data line DATA during a current setting operation for each row. This is advantageous for the current setting operation especially when the current signal supplied to the data line DATA is small.

Figure 17:
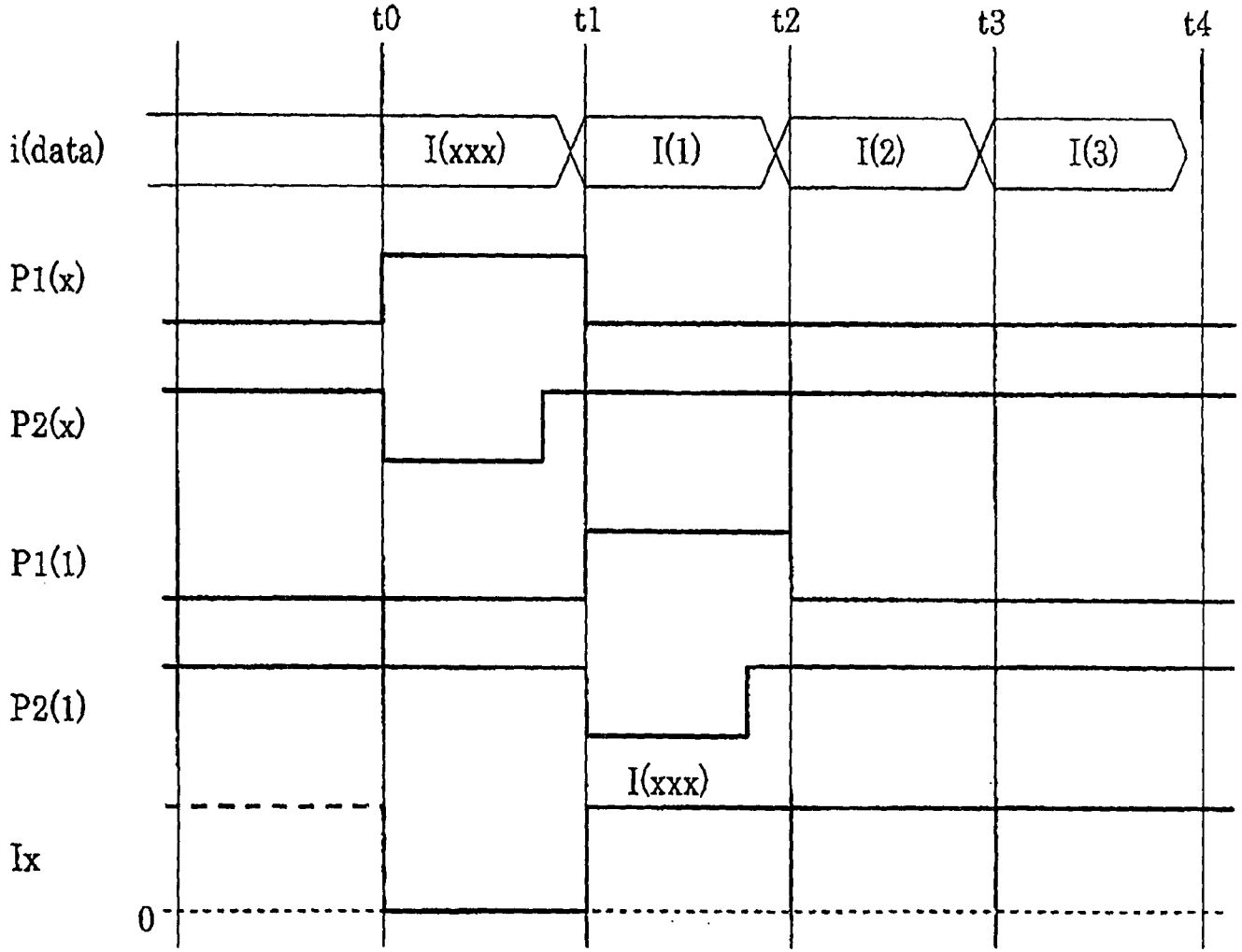
FIG. 17 is a view for explaining the embodiment of the invention.

FIG. 17 is a time chart for explaining a current setting operation in the current source setting circuit 1621*b*. A current setting period from t0 to t1 is provided before a current setting period (from t1 to t2) for the first row. In the period from t0 to t1, the current supplied to the data line DATA is set at a predetermined value I(xxx), and a current Ix is set at the transistor M1601 according to signals of the control lines P1(x) and P2(x). At the time t1 when current setting for the first row is started, the predetermined current I(xxx) is generated at the transistor M1605 to enable the feedback type voltage buffer 1621*a*. The predetermined current I(xxx) can be easily set by a signal level in a vertical blanking period of an input video signal. Since the use of the feedback type voltage buffer 1621*a* allows a voltage on the data line DATA to be substantially equal to a voltage on the auxiliary data line xxx, a reduction of the voltage on the data line DATA during the current setting operation for each row can be smaller than that in the case wherein the voltage buffer circuit is a source-follower. There is no need for increasing the voltage of the power source VCC for circuit operations. Even when the threshold voltages Vth or driving coefficients β of the transistors M1608/M1607 and the transistors M1610/M1609 become unbalanced to result in an offset of the voltage on the auxiliary data line xxx from the voltage on the data line DATA, since the offset is small and constant compared to that in a configuration employing a source-follower, there is no influence on the current setting operation for each row. Even when the threshold voltages Vth or driving coefficients β of the current mirror M1608/M1605 become unbalanced to result in some offset of the current at the transistor M1605 from the predetermined current I(xxx), there is no influence on the voltage buffering operation of the feedback type voltage buffer 1621*a*. Therefore, the circuit operations in the configuration of FIG. 16 can be preferably used on an EL panel drive circuit constituted by TFT elements having non-uniform transistor characteristics. The transistor types, i.e., n- and p-types in FIG. 16 are specified merely as an example, and the transistor types may be appropriately changed in accordance with changes in the polarities of the signals on the row scan lines P1(n) and P2(n) and the control lines P1(x) and P2(x) and changes in the connection of the EL elements.

Figure 19:
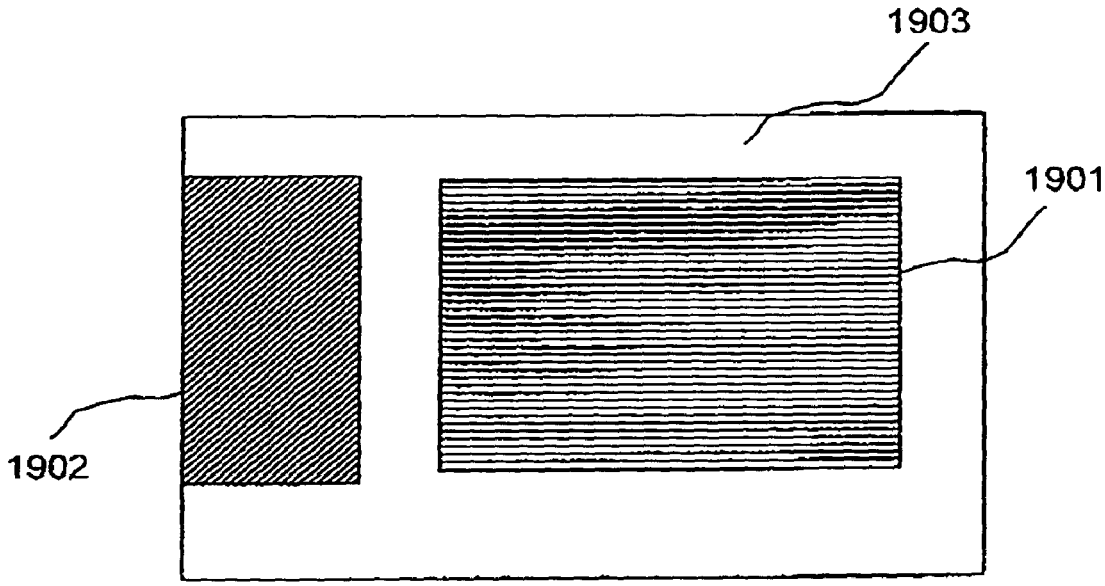
FIG. 19 is a view for explaining an embodiment of the invention.

FIG. 19 is a view for explanation of the construction of an information display apparatus in which the EL panel explained in the aforementioned embodiment is used as a display device. This information display apparatus may take any form such as a mobile phone, a mobile computer, a still camera or a video camera, or may be an apparatus which realizes a plurality of functions from among these functions. A display device 1901 corresponds to the EL panel explained in the aforementioned embodiment. Reference numeral 1902 denotes an information input part. In the case of a mobile phone, the information input part includes an antenna. In the case of, for example, a PDA or a mobile personal computer, the information input part includes an interface part for networks. In the case of a still camera or a movie camera, the information input part includes a sensor part using a CCD, a CMOS or the like. Reference numeral 1903 denotes a body which holds the information input part 1902 and the display device 1901.

The use of a drive circuit according to the invention as described above makes it possible to set a gate voltage of a current-drive transistor preferably.

What is claimed is:

1. A display apparatus comprising:

a plurality of pixel circuits arranged in a row direction and a column direction, each including a current-driven display element and a current-drive transistor for passing a current according to a current signal through the current-driven display element;

a current signal line provided along a column of the pixel circuit for sequentially supplying the current signal to each of the pixel circuits in the column;

wiring provided along the column of the pixel circuit for supplying a voltage to a gate electrode of the current-drive transistor of the pixel circuit to which the current signal is supplied through the current signal line; and a voltage buffer provided between the current signal line and the wiring for feeding back a voltage of the current signal line to a voltage of the wiring, wherein the voltage buffer includes a source-follower circuit to which the voltage of the current signal line is input and from which the voltage applied to the gate electrode of the current-driven transistor is output on the wiring.

2. A display apparatus according to claim 1, wherein the current-driven display element is an electroluminescent element.

3. An information display apparatus for performing display in accordance with information inputted thereto, having an information input part and a display apparatus according to claim 1 that performs display in accordance with information inputted to the information input part.

4. A display apparatus according to claim 1, wherein each pixel circuit has a first switch for controlling the connection between the current signal line and a drain electrode of the current-drive transistor, a second switch for controlling the connection between the drain electrode and the driven display element, and a third switch for controlling the connection between the wiring and the gate electrode of the current-drive transistor.

5. A display apparatus according to claim 4, wherein the first switch and the second switch are controlled such that there is a first period in which the first switch keeps the current signal line and the current-drive transistor connected to each other and the second switch keeps the current-drive transistor and the driven display element disconnected from each other and such that there is a second period in which the first switch keeps the current signal line and the current-drive transistor disconnected from each other and the second switch keeps the current-drive transistor and the driven element connected to each other.

6. A display apparatus according to claim 1, wherein the voltage buffer has a current source and a current value of the current source corresponds to a current supplied to the current signal line during a predetermined period.

7. A display apparatus according to claim 6, further comprising a switch for controlling connection between a current supply circuit and the current signal line.

8. A display apparatus according to claim 7, wherein the current supply circuit and the current signal line are connected for a predetermined period before a gate potential of the current-drive transistor is determined according to the current signal and are disconnected from each other after the predetermined period passes.

* * * * *

UNITED STATES PATENT AND TRADEMARK OFFICE

CERTIFICATE OF CORRECTION

PATENT NO. : 7,212,195 B2
APPLICATION NO. : 10/650834
DATED : May 1, 2007
INVENTOR(S) : Somei Kawasaki It is certified that error appears in the above-identified patent and that said Letters Patent is hereby corrected as shown below:

COLUMN 11:

Line 52, “sistors. should read --sistor.--.

COLUMN 13:

Line 20, “in” should read --is--.
Line 64, “As” should read --As is--.

Signed and Sealed this

Eighteenth Day of November, 2008

JON W. DUDAS
*Director of the United States Patent and Trademark Office*